US010400537B2

(12) United States Patent
Oag et al.

(10) Patent No.: US 10,400,537 B2
(45) Date of Patent: Sep. 3, 2019

(54) TOOL FOR SEVERING OR ASSISTING IN THE SEVERING OF A CONDUIT

(71) Applicant: SPEX ENGINEERING (UK) LIMITED, Aberdeenshire (GB)

(72) Inventors: Jamie Oag, Aberdeen (GB); Rae Younger, Aberdeenshire (GB)

(73) Assignee: SPEX ENGINEERING (UK) LIMITED, Aberdeen (GB)

( * ) Notice: Subject to any disclaimer, the term of this patent is extended or adjusted under 35 U.S.C. 154(b) by 0 days.

(21) Appl. No.: 15/554,789

(22) PCT Filed: Mar. 3, 2016

(86) PCT No.: PCT/GB2016/050562
§ 371 (c)(1),
(2) Date: Aug. 31, 2017

(87) PCT Pub. No.: WO2016/139481
PCT Pub. Date: Sep. 9, 2016

(65) Prior Publication Data

US 2018/0238132 A1 Aug. 23, 2018

(30) Foreign Application Priority Data

Mar. 3, 2015 (GB) ..... 1503608.0

(51) Int. Cl.
*E21B 29/02* (2006.01)
*E21B 33/06* (2006.01)

(52) U.S. Cl.
CPC ..... *E21B 29/02* (2013.01); *E21B 33/063* (2013.01)

(58) Field of Classification Search
CPC ..... E21B 29/02; E21B 33/063
See application file for complete search history.

(56) References Cited

U.S. PATENT DOCUMENTS 4,180,131 A 12/1979 Chammas
4,619,556 A * 10/1986 Parra ..... E02D 9/005 405/195.1
6,702,009 B1 3/2004 Drury et al.
(Continued)

FOREIGN PATENT DOCUMENTS

WO 2013066340 A1 5/2013

OTHER PUBLICATIONS

International Search Report dated May 24, 2016 for corresponding International application No. PCT/GB2016/050562.
(Continued)

*Primary Examiner* — Caroline N Butcher
(74) *Attorney, Agent, or Firm* — Tarolli, Sundheim, Covell & Tummino LLP

(57) ABSTRACT

A tool for severing a conduit includes a housing defining a void that encircles a conduit to be severed. There is at least one propellant source located within the housing. Upon ignition by an ignition mechanism, the propellant source deflagrates, creating at least one stream of combustion products. The combustion products flow out of the tool through at least one void access and into the void. The void access channels the combustion products towards the conduit. The stream of combustion products combines with a modifying material to sever or assist in severing the conduit. A method of severing a conduit using the tool is provided.

58 Claims, 16 Drawing Sheets

(56) References Cited

U.S. PATENT DOCUMENTS

| | | | | |
|---|---|---|---|---|
| 2008/0257549 | A1 | 10/2008 | Swor et al. | |
| 2011/0283872 | A1* | 11/2011 | Brooks | E21B 29/02 89/1.15 |
| 2012/0118568 | A1* | 5/2012 | Kleefisch | E21B 7/14 166/297 |
| 2012/0199351 | A1 | 8/2012 | Robertson | |
| 2013/0112320 | A1* | 5/2013 | Wright | B23K 7/00 148/194 |
| 2014/0034315 | A1 | 2/2014 | Tallini et al. | |
| 2014/0224500 | A1* | 8/2014 | Wilie | E21B 29/02 166/363 |
| 2014/0238678 | A1 | 8/2014 | Arrell, Jr. et al. | |
| 2016/0290082 | A1* | 10/2016 | Younger | E21B 29/02 |

OTHER PUBLICATIONS

UKIPO Search and Examination reported dated Sep. 9, 2016 for corresponding GB Application No. 1603719.4.

* cited by examiner

TOOL FOR SEVERING OR ASSISTING IN THE SEVERING OF A CONDUIT

RELATED APPLICATIONS

The present invention is a U.S. National Stage under 35 USC 371 patent application, claiming priority to Serial No. PCT/GB2016/050562, filed on 3 Mar. 2016; which claims priority from 1503608.0, filed 3 Mar. 2015, the entirety of both of which are incorporated herein by reference.

FIELD

The present invention relates to a tool for severing or assisting in the severing of a target. In some embodiments, the present invention relates to a tool for severing or assisting in the severing of a conduit in a hydrocarbon extraction well at a location above the in-situ well completion.

BACKGROUND

During hydrocarbon extraction operations, safety equipment is installed for utilisation in the event of catastrophic failure to prevent damage to human life, the environment, assets (tangible and intangible) and also prevent wider societal impacts. This is particularly the case for subsea hydrocarbon extraction where the presence of water can carry contamination from an oil well many thousands of miles, potentially causing huge environmental damage.

During drilling operations and some well intervention operations, the primary barrier utilised to shut a well is the blow out preventer (BOP), which sits on the wellhead. For a subsea well, a riser links the oil rig to the BOP, the riser allowing the passage of drilling equipment, drilling tools, completion equipment and completion tools, particularly conduits such as wellbore tubulars, from the oil rig into the oil well through the BOP. In the event of a major well control event, it is beneficial to be able to sever conduits such as tubulars, including drill pipe and the like, within the riser to, first, permit successful detachment of the rig from the well head and, second, allow the severed conduit to move out of the way from the closure mechanism of the BOP, allowing the blow out preventer to close more easily.

The Deepwater Horizon/Macondo well blowout and explosion incident on 10th April 2010 highlighted a number of technical deficiencies in well control equipment used at the time and which are still in use today. A key issue highlighted was that BOPs, in use, had major limitations in terms of being able to successfully isolate the BOP in a major well control incident when there were 'non-shearable' items such as large diameter casing, drill pipe or a drill collar across the BOP. Furthermore, BOPs were designed for severing centralised shearable items across the BOP and not non-centralised shearable items, that may also be under 'effective compression'.

SUMMARY

According to a first aspect of the present invention there is provided a tool for severing or assisting in the severing of a conduit, the tool comprising:

a housing defining a void, the void arranged, in use, to at least partially encircle a conduit;

an at least one propellant source located within the housing;

an at least one void access, the/each void access having an inlet and an outlet, the/each void access inlet being in fluid communication with the housing and the/each void access outlet being in fluid communication with the housing void;

an ignition mechanism for igniting the/each propellant source; and an at least one modifying material;

wherein, upon ignition, the/each propellant source deflagrates, creating an at least one stream of combustion products, the/each stream of combustion products flowing out of the tool through the/each void access in to the void, the/each void access channelling the/each stream of combustion products towards the conduit, the/each stream of combustion products combining with the/each modifying material to sever or assist in severing the conduit.

A propellant is an explosive material which has a low rate of combustion and once ignited deflagrates (burns) or otherwise decomposes to produce propellant gas. This gas when confined is pressurised, the pressure driving the gas and other combustion products away from the propellant, forming a stream of combustion products. A propellant can deflagrate smoothly and at a uniform rate after ignition without depending on interaction with the atmosphere, and produces propellant gas and/or heat on combustion and may also produce additional combustion products.

In the preferred embodiments, by "conduit" it is meant any object that is run into a wellbore or forms part of an oil and gas wellbore completion or well drill string or well intervention system, whether hollow, like a tubular, or solid like a wellbore drift. "Conduit" includes, but is not limited to, braided wire, coiled tubing, drill pipe, production tubing, casing, riser, well intervention tools and well completion tools. Conduits may be cylindrical or non-cylindrical.

In at least one embodiment of the invention a tool is provided which uses a stream of combustion products created by combustion of a propellant source combined with a modifying material to sever or assist in severing a conduit. This is achieved by processes such as ablation, severing, displacement, removal, heating, abrasion, or erosion.

The combination of a stream of combustion products propelled towards the conduit at high pressure and a modifying material, will manipulate the conduit causing severance, or at least change the physical properties, of a section of the conduit to permit other conventional tools, such as blowout preventer shear rams, to complete severance.

The housing void may be a housing throughbore, the housing throughbore, in use, encircling a conduit.

The tool may be configured to be used above a cased wellbore.

In use, the/each stream of combustion products may heat the conduit, in some cases to a temperature sufficient to soften the conduit, and the modifying material may impinge on at least a portion of the conduit, transferring energy to the conduit to be manipulated, thereby forcibly displacing or moving the conduit portion.

The/each void access may be channelled towards a focal point. The focal point of a void access is where the stream of combustion products from that void access is most intense.

At least one void access may be fixed relative to the housing.

Alternatively or additionally, at least one void access may be movable with respect to the housing.

Where the void is a throughbore, the at least one void access may provide circumferential access to the housing void. Either one circumferential void access or multiple void accesses can be provided to enable the stream of combustion products and modifying material to have 360° access to the void.

In a preferred embodiment there may be a plurality of void accesses.

Where there is a plurality of void accesses, the void accesses may be arranged in an array.

The array may be a linear array.

The array may be a tiered array.

A first array of void accesses or a first tier of an array of void accesses may lie on a first plane, the first plane being substantially perpendicular to a longitudinal axis of the void.

Second and subsequent arrays of void accesses or second subsequent tiers of void accesses may lie in second and subsequent planes respectively, perpendicular to the longitudinal axis of the void.

Each void access in any given array of void accesses may have a focal point the same distance from the void longitudinal axis as every other void access in the same array.

Each void access in one array may have a focal point at a different distance from the void longitudinal axis as every other void access in another array.

A stream of combustion products and modifying material may flow through each void access or array of void accesses in a sequence. Such an arrangement permits the focus of the streams of combustion products to move, for example, towards the void longitudinal axis as the arrays are utilised. In one embodiment, where there are arrays of void accesses, the first array is focused on the surface of the conduit to be manipulated and the subsequently utilised second array is focused 10 mm to 15 mm, for example, to the tool longitudinal axis. In this way, the stream of combustion products and modifying material passing through the first array penetrates the outer surface of the conduit. Once the maximum effectiveness of this stream of combustion products and modifying material has peaked, a stream of combustion products and modifying material passes through the second array which is focused slightly further into the conduit, maintaining the efficiency of the severing process. This transfer of flow could be achieved by, for example, the second array having a separate propellant source which is triggered later than the propellant source associated with the first array, or there could be relative movement between the propellant source and the void access arrays such that the alignment of the propellant source moves from the first array of void accesses to the second array of void accesses.

At least one void access may share a focal point with at least one other void access. Such an arrangement allows multiple streams of combustion products and modifying material to converge on, for example, a point on the surface of the conduit.

The/each void access may be defined by a housing wall.

The/each void access may be an aperture in the housing wall, the/each aperture having a sidewall.

The aperture sidewall may channel the stream of combustion products and/or the/each modifying material.

The tool may include an at least one carrier, the/each void access being mounted to the/each carrier.

The/each carrier may be movable between a retracted position and a deployed position.

In the retracted position, the/each carrier may be clear of the void, and in the deployed position the/each carrier may encroach the void.

In the deployed position the/each carrier may be adjacent to the conduit. Bringing the void accesses into the proximity of the conduit gives a greater chance of successful operation of the tool as it minimises the distance that the/each stream of combustion products and modifying material has to travel.

The carrier may comprise rams movable in a plane perpendicular to the tool void.

The carrier may comprise rollers configured to rotate into engagement with the conduit.

The rollers may define a recess for receiving the conduit.

In at least one embodiment of the present invention the or at least one of the modifying materials may include solid particles. Solid particles can cause abrasion of the material to be manipulated.

Alternatively or additionally the or at least one of the modifying materials may include liquid droplets. Liquid droplets can cause erosion of the material to be manipulated and be a very good thermal transfer mechanism.

The or at least one of the modifying materials may be contained within the propellant source.

The or at least one of the modifying materials may be a metal.

The metal may at least partially melt as the/each propellant source deflagrates.

In other embodiments, the or at least one of the modifying materials may have been substantially solid, for example garnet.

In some embodiments, the metal may, additionally or alternatively, at least partially oxidise.

The or at least one of the modifying materials may be formed by the at least partial deflagration of the/each propellant source.

Alternatively or additionally, the or at least one of the modifying materials may be formed separately from the deflagration of the/each propellant source.

Alternatively or additionally, the or at least one of the modifying materials may be present in the tool prior to ignition of the/each propellant source.

In at least one embodiment the or at least one of the modifying materials may be introduced into the/each stream of combustion products.

In at least one embodiment the or at least one of the modifying materials may be mechanically or forcibly introduced into the propellant gas and/or the/each stream of combustion products.

The tool may include an at least one sacrificial portion.

The/each sacrificial portion may comprise the or at least one of the modifying materials.

In at least one embodiment, the/each stream of combustion products may erode the sacrificial housing portion, erosion of the sacrificial housing portion releasing at least one modifying material into the/each stream of combustion products.

The/each sacrificial portion may form part of the sidewall of the/each void access.

Alternatively or additionally, where the void access sidewall includes a sacrificial portion, erosion of the sacrificial portion may change the focal point of the void access.

The tool may include a positioning mechanism for positioning a conduit, in use, with respect to the/each void access.

The positioning mechanism may centre the conduit with respect to the void. Positioning the conduit in a known location ensures a consistency of performance of the tool.

The positioning mechanism may comprise a plurality of positioning devices, each device being configured to engage the conduit.

The positioning mechanism may centre the conduit with respect to the longitudinal void axis.

In alternative embodiments, the/each void access may be movable with respect to the conduit to a position where the severing action of the/each stream of combustion products and modifying material is optimised. In this embodiment, the/each void access move towards the conduit rather than the conduit being positioned adjacent to the/each void access.

The tool may be configured, within a fluid filled environment, to locally purge the medium between the void accesses and the conduit, and replace this medium with a medium of lower density or a fluid with beneficial effects. It is desirable to remove well fluids from the section and/or to reduce pressure within the section to maximise the severing of the tool on the conduit. Fluids and solids, in particular, within the wellbore can provide an extremely dense medium through which the stream of combustion products and modifying material have to pass. This can significantly reduce the energy of the/each stream of combustion products and modifying material have an adverse effect on their ability to sever or assist in severing the conduit. By purging, for example, a fluid in the wellbore and replacing the fluid with a lower density gas, the tool then produces a stream of combustion products within a gaseous environment, thereby reducing the energy lost during the passage of the stream of combustion products and modifying material to the conduit.

The medium of lower density may be a gas.

The tool may produce the gas through propellant combustion.

The gas may be used to displace the fluid in the vicinity of the tool.

In some embodiments, the gas may flow through the void accesses and, is utilised to channel the stream of combustion gases and additional material towards the conduit.

The tool may further include a sealing mechanism.

The sealing mechanism may be adapted to form a seal to isolate a section of the conduit. In one embodiment the use of two or more seals may be desirable to isolate the section of the conduit to be severed.

In at least one embodiment of the present invention, the sealing mechanism is a packer or sealing element above and/or below the housing.

The tool may comprise a restraining or fastening mechanism. In at least one embodiment of the present invention the tool restrains the conduit while the stream of combustion products and modifying material severs or assists in severing the conduit. This would allow more time for the stream of combustion products and modifying material to interact with the conduit at a single stationary target location.

The restraining or fastening mechanism may form a seal on the conduit to assist in, at least partially, confining the stream of combustion products and modifying material to a stationary conduit location.

The tool may be configured to impart additional forces onto the conduit. In at least one embodiment of the present invention these forces are beneficial in assisting the stream of combustion products and modifying material in interacting with the conduit and severing the conduit.

In at least one embodiment of the present invention the tool imparts additional forces which move the conduit, to expose the conduit to the stream of combustion products and modifying material.

The tool may move the conduit by, for example, rotation.

Alternatively or additionally the tool may apply torsion, tension or bending to the conduit. These additional forces may assist in conduit penetration, displacement and/or severance.

The at least one stream of combustion products and/or the/each modifying material may apply torsion or tension or bending to the conduit.

The tool may be configured to move the streams of combustion products such that they impinge at a predetermined position on a moving conduit. The movement may be driven mechanically, electrically or magnetically. In some embodiments the propellant combustion products' reaction force and/or propellant by-products drive the movement.

The tool may be configured to move the streams of combustion products in a single direction.

The tool may be configured to rotate the/each stream of combustion products and modifying material around the conduit.

The tool may be configured to rotate the/each stream of combustion products in a vortex. By utilising vortices, adjacent streams can interact to combine or push apart.

The tool may further comprise a shearing mechanism.

The shearing mechanism may be a mechanical shearing mechanism.

The shearing mechanism may be configured to be driven by propellant combustion gases.

The shearing mechanism may be configured to act at or next to the location where the stream of combustion products and modifying material are directed.

The tool may further comprise a scraping mechanism to scrape away molten or softened conduit material.

There may be a plurality of propellant sources.

Where there is the plurality of propellant sources, each propellant source may combust separately.

Where there is the plurality of propellant sources, at least some of the propellant sources may be ignited in a sequence.

At least one of the propellant sources may be used as a structural component on or within the tool.

In at least one embodiment of the present invention, a portion of the structure of the tool is made from propellant which deflagrates when the tool operates, leaving minimal debris to recover.

The/each propellant source and, in some embodiments the associated ignition mechanism, may be thermally insulated from well temperatures and/or potentially high temperatures from the stream of combustion products and/or modifying material. Thermally insulating the propellant sources (the associated ignition mechanism) can prevent thermal degradation, and a possible reduction in performance, of the propellant sources and, in some cases the associated ignition mechanism. In other embodiments or in the same embodiments, the/each propellant sources and, in some embodiments the associated ignition mechanism, may be shielded from well pressure.

In some embodiments the at least one modifying material may be thermally insulated.

In some embodiments, additional energy can be imparted to the/each stream of combustion products and/or the each modifying material by ionisation.

The/each stream of combustion products and/or the/each modifying material may be at least partially ionised by at least part of the/each stream of combustion products and/or the/each modifying material coming into contact with an electrical arc.

The/each stream of combustion products and/or the/each modifying material may be ionised by passing through an induction coil.

In some embodiments, additional energy can be imparted to the/each stream of combustion products and/or the/each modifying material by passing at least a portion through a magnetic field and/or electric field.

In some embodiments, additional energy can be imparted to the/each stream of combustion products and/or the/each modifying material by passing at least a portion through microwave radiation.

In some embodiments, additional energy can be imparted to the/each stream of combustion products and/or the/each modifying material by raising its temperature.

In some embodiments, additional energy increases the volume and/or temperature and/or pressure of the/each stream of combustion products and/or the/each modifying material and excites the molecules.

Additional energy can be imparted to the/each stream of combustion products and/or the/each modifying material in the/each void access.

Alternatively, additional energy can be imparted to the/each stream of combustion products and/or the/each modifying material outside the/each void access.

According to a second aspect of the present invention there is provided a method of severing or assisting in the severing of a conduit, the method comprising the steps of:

providing a tool having a housing, the housing defining a void, the void at least partially encircling a conduit to be severed;

igniting an at least one propellant source located within the housing, the/each propellant source upon deflagration creates an at least one stream of combustion products, the/each stream of combustion products flowing out of the tool through an at least one void access, the/each void access channelling the/each stream of combustion products towards the conduit, the/each stream of combustion products combining with at least one modifying material to sever or assist in severing the conduit.

According to a third aspect of the present invention there is provided a severance tool for severing a target, the severance tool comprising:

a housing;

at least one chamber for housing a propellant source;

at least one nozzle, the/each nozzle having an inlet and an outlet, the/each inlet being in fluid communication with at least one chamber; and at least one mechanism for igniting the/each propellant source;

wherein, upon ignition, at least one of the propellant sources combusts to release combustion gas in the form of at least one combustion jet, which, in use, flows out of the severance tool through the/each nozzle outlet towards the target.

The target may be a conduit.

Some or all of the propellant may comprise a solid.

Preferably, some or all of the propellant may comprise a liquid.

The composition of the propellant source may be adjusted to change the combustion temperature, the quantity of gas produced, the by-products produced and any similar desirable feature.

The combusting area of the propellant source may be configured to achieve a desired combustion rate. The geometry of solid propellant may be adjusted to decrease or increase the propellant combustion rate. This may be achieved by modifying the surface area which combusts (for example a star-shaped cross-section will deflagrate faster than an equivalent size of solid cylindrical propellant). The propellant combustion rate may remain constant or may increase or reduce during operation.

In at least one embodiment, the/each combustion jet may be a stream of combustion products.

In at least one embodiment, the/each combustion jet may comprise one or more of propellant gas, heat and/or combustion products.

In at least one embodiment the propellant source(s) may combust continuously.

The propellant source(s) may combust intermittently.

The/each combustion jet may be continuous. Alternatively the/each combustion jet may be intermittent.

The/each combustion jet may be circumferential, radially focussed inwards. The/each combustion jet may share a single common focus or may be directed at different locations on the target. The/each combustion jet may be stationary in operation. The/each combustion jet may move or have active/passive control.

In some embodiments, the/each combustion jet may be biased to a particular direction.

In some embodiments, when directed through a nozzle, the/each combustion jet can be accelerated.

The/each combustion jet may be accelerated by imparting additional energy to the/each combustion jet.

Alternatively or additionally, the/each combustion jet may be raised in temperature by imparting additional energy to the/each combustion jet.

The propellant sources may be a single state, a solid, liquid or gas or may be in two or more states.

Alternatively the propellant sources may be in separate states, which are combined at or prior to combustion initiation.

Alternatively or additionally the propellant sources may change state prior to ignition.

There may be a plurality of propellant sources.

Where there is a plurality of propellant sources, each propellant source may combust separately.

In this embodiment, one propellant source may be separated from an adjacent propellant source by means of a barrier.

The barrier may comprise a non-combustible layer.

The barrier may comprise a void.

The void may be defined by adjacent propellant sources.

Where there is a plurality of propellant sources, at least some of the propellant sources may be ignited in a sequence, or alternatively, substantially simultaneously.

Where there is a plurality of propellant sources, at least some of the propellant sources may be equidistant from a nozzle inlet, or alternatively, arranged at varying distances from a nozzle inlet.

Where there is a plurality of propellant sources, at least some of the propellant sources may be associated with its own nozzle inlet, or alternatively, share a nozzle inlet.

The tool may comprise at least one source of additional material.

The additional material may be a modifying material, adapted to manipulate the target by, for example, ablation, severing, shearing, displacement, removal, heating, abrasion, or erosion.

The/each additional material source may be solid, liquid and/or gas or any combination thereof.

In at least one embodiment of the tool the/each combustion jet and/or additional materials may be generated within the tool without generating heat or with minimal heat generation. Certain types of propellant can combust without generating heat. The propellant gas, combustion products and/or additional materials interact with the target, and the risk of igniting flammable materials that may be present or in close proximity is reduced or eliminated.

There may be a plurality of combustion jets.

In at least one embodiment of the present invention the/each nozzle outlets projects a combustion jet, comprising propellant gas, combustion products and/or additional materials.

In at least one embodiment of the present invention the/each nozzle directs or biases the/each combustion jet in a particular direction. The/each nozzle can include a venturi or de laval or similar geometry to expand and/or accelerate the/each combustion jet, which imparts greater speed and/or kinetic energy to the ejected media from the tool.

Additionally the/each nozzle imparts a desired shape to the/each combustion jet which is ejected from the tool.

At least one of the/each combustion jet may be linear.

At least one of the/each combustion jet may be circumferential.

At least one of the/each nozzle may impart a rotation to the/each combustion jet.

At least one of the/each nozzle may bifurcate the/each combustion jet into two or more combustion jets.

At least one of the/each nozzle may comprise a screen with a plurality of holes for creating a plurality of combustion jets.

At least a portion of at least one nozzle may point obliquely inwards from the tool housing.

At least a portion of at least one nozzle may point perpendicularly inwards from the tool housing.

At least a portion of each of a plurality of nozzles may point in convergent directions.

In at least one embodiment of the present invention convergent nozzles create a combustion jet that has greater penetration than the/each combustion jet created by a single nozzle.

At least some of the/each nozzle may point in convergent directions and their respective combustion jets converge at the target surface.

At least some of the/each adjacent nozzle may point in convergent directions and their respective combustion jets converge before reaching the target surface.

A thrust/reaction force from a nozzle may be used to move the tool.

The thrust/reaction force from a nozzle may be used to bring the tool into closer proximity to the target.

The thrust/reaction force from a nozzle may be used to move components within the tool.

In at least one embodiment of the present invention the thrust from the tool moves the nozzle in a circular path to remove circular sections from the target.

The pressure generated by the combustion process may be used to move the tool.

The pressure generated by the combustion process may be used to bring the tool into closer proximity to the target.

The pressure generated by the combustion process may be used to move components within the tool.

The combustion chamber within the tool may maintain a constant volume.

In at least one embodiment of the present invention the pressure generated by the combustion process moves the propellant within the tool to maintain a constant volume combustion chamber.

The tool may comprise an air source to combust the propellant.

At least one of the/each mechanism for igniting the propellant may comprise an electro-pyrotechnic igniter. Electro-pyrotechnic igniters are controlled electrically, for example with a heated bridgewire or a bridge resistor.

In at least one embodiment of the present invention an electro-pyrotechnic igniter may be safer to operate than a purely pyrotechnic igniter or series of instantaneous igniters At least one of the/each mechanism for igniting the propellant may comprise a pyrogen.

The pyrogen may comprise a pyrotechnic composition made of a fuel and an oxidiser. In use, the fuel produces a significant amount of hot particles that cause or promote the ignition of the propellant.

At least one of the/each mechanism for igniting the propellant may comprise an electrical igniter. In at least one embodiment of the present invention an electrical igniter is safer to operate and handle than a pyrotechnic igniter.

Optionally the electrical igniter may comprise a bridgewire.

Alternatively or additionally the electrical igniter may be adapted to create a spark.

At least one of the/each mechanism for igniting the propellant may comprise a chemical igniter.

In this embodiment, at least one nozzle may be aligned such that the/each combustion jet generated on combustion of the propellant source travels in a direction which is non-perpendicular to the target surface.

A plurality of nozzles may be aligned such that the/each combustion jets generated on combustion of the propellant source travel in a direction which is non-perpendicular to the target surface.

At least one nozzle may be aligned such that the/each combustion jet released upon propellant source combustion is directed, in use, at the target longitudinal axis.

Additionally or alternatively, where the target is a tubular element, at least one nozzle may be aligned such that the/each combustion jet released upon combustion of the propellant source is directed at a tangent to a target internal surface.

In some embodiments, at least one nozzle is aligned such that the/each combustion jet released upon combustion of the propellant source is directed at a trajectory such that the energy of the/each combustion jet is dissipated within the material from which the target is made.

In some embodiments, at least one nozzle is aligned such that the/each combustion jet released upon combustion of the propellant source is directed at a trajectory such that the energy of the/each combustion jet is dissipated at or adjacent to the target internal surface.

In some embodiments, where the target is tubular, at least some of the nozzles may be aligned such that the/each combustion jet released by combustion of the propellant source is directed at a tangent to the target internal surface. By directing the/each combustion jets released upon combustion of the propellant source tangentially to the target internal surface, the distance the/each combustion jet travels through the target is maximised thereby maximising the damage caused by the/each combustion jet on the target material.

The nozzles may be aligned such that the/each combustion jet released upon combustion of the propellant source cooperates with the/each combustion jet released by another nozzle to create separation forces and/or cavities within the target.

In some embodiments, the nozzles may be grouped and aligned such that the/each combustion jets released upon combustion of the propellant source of one group of nozzles cooperate with the/each combustion jets released by another group of nozzles to create separation forces and/or cavities within the target.

The tool may comprise at least one outlet for evacuating or venting the combustion products generated by the combustion of the propellant source(s). The at least one outlet may comprise a bleeding bore used to vent gas. Alternatively or additionally, the outlet may comprise a pressure relief member.

The outlet for evacuating or venting the combustion gases may be configured to send a shockwave downhole for attenuating a pressure surge.

The tool may comprise a protecting sleeve for protecting the propellant source(s) from the tool environment.

The outlet for evacuating or venting the combustion gases may be configured to move the protecting sleeve.

The at least one chamber for housing a propellant source may be movable with respect to the tool housing.

The tool may comprise a combustion chamber for carrying out the combustion of the propellant source.

The tool may comprise flanges for connecting the tool to other well equipment.

The tool may comprise one or more linear shaped charges.

The tool may comprise at least one ram wherein such rams are configured to eject at least one combustion jet. In at least one embodiment of the present invention a pair of rams debilitate the target material by ejecting combustion jets from the front of the rams and subsequently sever the target by applying compression forces with the rams.

The at least one ram may be at least partially driven by combustion products from the propellant source combustion.

The tool may be used to supplement and enhance other conventional target severing methods. In at least one embodiment of the present invention the tool releases combustion jets to debilitate or soften the target which is cooperatively severed by linear shaped explosive charges.

The at least one chamber for housing the propellant source may be configured to resist oilwell pressures externally.

The present invention can be used to sever targets independently of the environmental pressure. It can be used on the surface but it can also be used at high pressures, such as those found in oilwell environments. It is understood that high environmental pressures favour the combustion of the propellant source and produce a more consistent severance, due to the fact that the/each combustion jet is more focused due to pressure, i.e. it is less dispersed.

The tool may be configured to create, in use, a gas bubble from the combustion gas between the nozzles and the target.

The tool may comprise a sacrificial portion mounted on a target for facilitating severance of the target.

The sacrificial portion may be clamped on the target.

The sacrificial portion may be a part mechanically weaker than the rest of the target.

The sacrificial portion may comprise a part with a lower melting point than the rest of the target.

The sacrificial portion may comprise a part which is mechanically weaker and with a lower melting point than the rest of the target.

In one embodiment, the sacrificial portion comprises a reinforced composite material able to withstand the same mechanical stresses as the rest of the target (such as a drillstring), the composite matrix being of a substantially lower melting point than the target material, such that, in an emergency event, the propellant jet is used to rapidly soften the composite matrix and the tool is able to rapidly and efficiently sever the target.

The tool may comprise a tracking system configured to track the position of the target relative to the tool or relative to the restraining mechanism.

The tool may further comprise a shearing mechanism.

The shearing mechanism may be a mechanical shearing mechanism.

The shearing mechanism may be configured to be driven by propellant combustion gases.

The shearing mechanism may be configured to act at or next to the location where combustion jet(s) are directed.

The shearing mechanism may contain, enclose or encompass a portion of the propellant source.

A portion of same propellant, which drives the mechanical shearing mechanism, may also be directed at the target.

The shearing mechanism may comprise a shearing mechanism.

The tool may be configured to sever the target by the cooperative action of the propellant combustion jet(s) and the shearing mechanism. In at least one embodiment of the present invention a portion of the target is removed by the propellant combustion jets while the remainder is severed or removed with the shearing mechanism. In another embodiment, a portion of the target is heated by the propellant combustion jet(s), allowing the shearing mechanism to more easily sever or otherwise interact with the target.

According to a fourth aspect of the present invention there is provided a severance tool for severing a target, the severance tool comprising:

a housing;

at least one propellant source;

a plurality of nozzles;

a nozzle holder adapted, in use, to encircle the target to be severed, the nozzle holder being adapted to hold the nozzles;

a trigger mechanism adapted to activate the/each propellant source; and a centralising means adapted, in use, to create relative movement between the target and the nozzle holder to centralise the target with respect to the nozzle holder.

It will be understood that the preferred and alternative features listed in connection with one aspect of the invention may be equally applicable to another aspect but have not been included for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
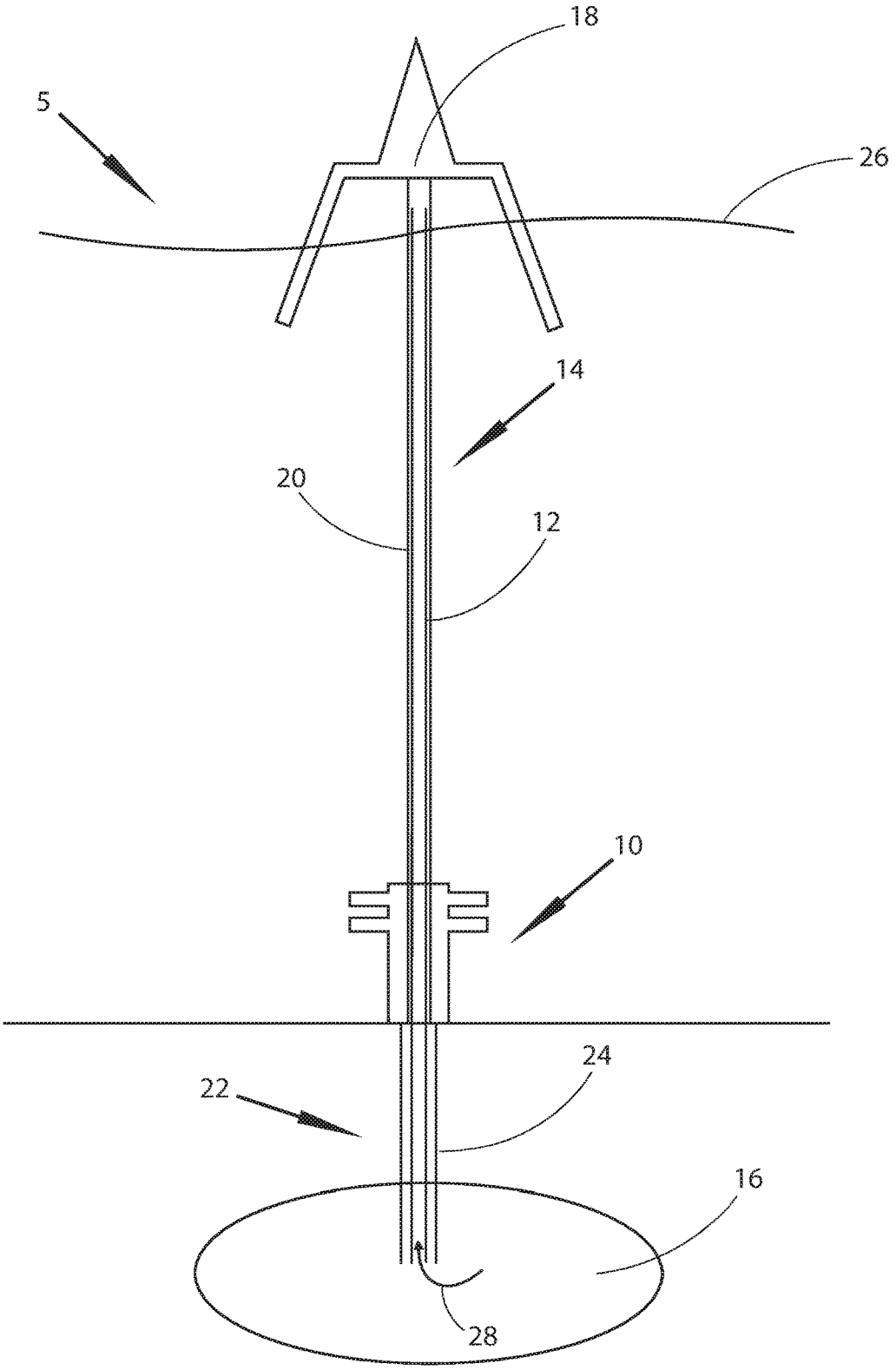
FIG. 1 is, a schematic of an oilwell incorporating a tool for severing or assisting in the severing of a conduit according to a first embodiment of the present invention.

Reference is first made to FIG. 1, a schematic of an oil well generally indicated by reference numeral 5, incorporating a tool 10 for severing or assisting in the severing of a conduit 12 according to a first embodiment of the present invention.

The tool 10 is part of a well string 14 providing fluid communication between a reservoir 16 and a rig 18. The primary components of the conduit 14 are a riser 20, the tool 10 and a wellbore 22 lined with a casing 24.

The rig 18 floats on the sea 26 and receives hydrocarbons from the reservoir 16 which flow into the well string 14, as indicated by the arrow 28, and particularly into the conduit 12, towards surface.

Figure 2:
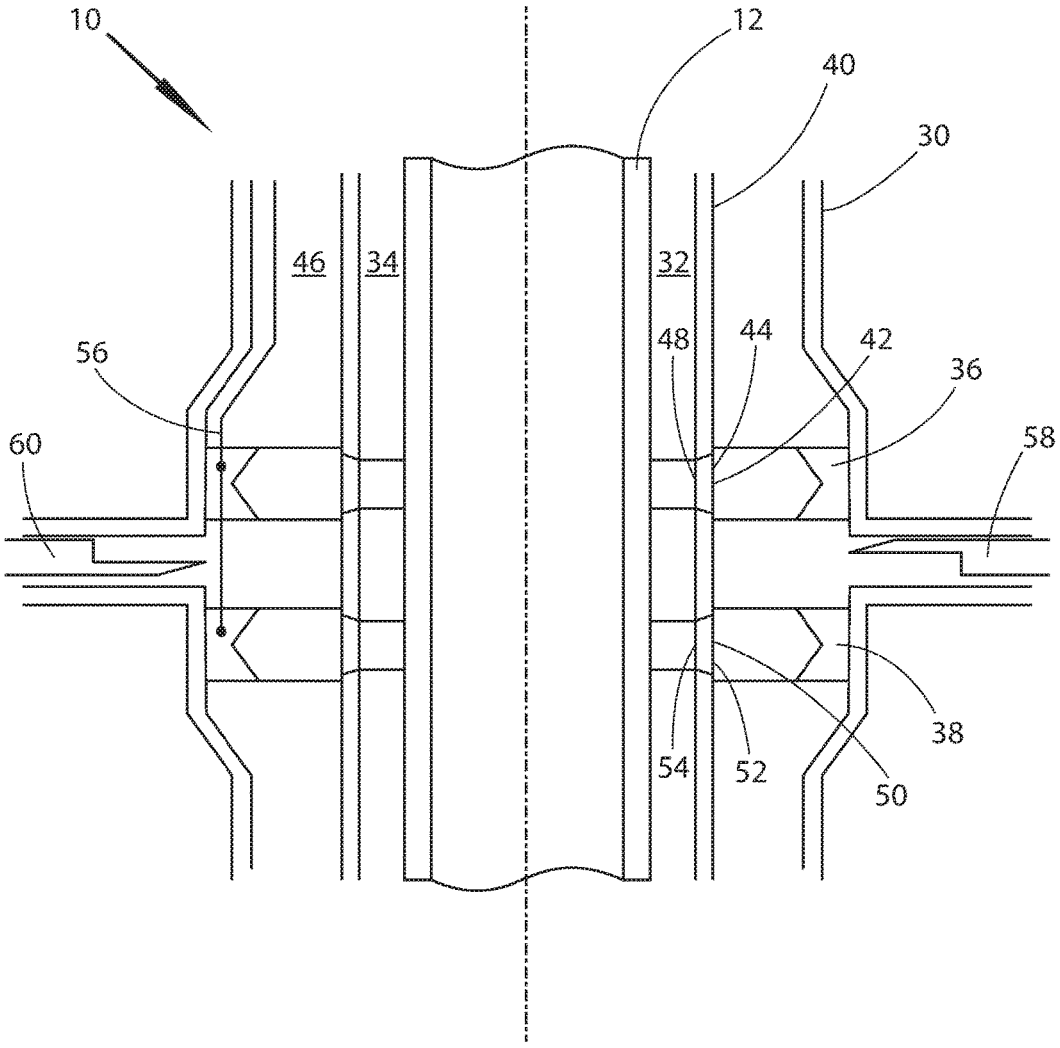
FIG. 2 is a section of the tool of FIG. 1.

Referring now to FIG. 2, a section of the tool 10, the tool 10 is an integral part of the blowout preventer (BOP) and comprises a housing 30 defining a void 32. The void 32 is a through bore 34 fully encircling the conduit 12. Located within the housing 30 is a first propellant source 36 and a second propellant source 38.

A housing internal wall 40 defines a first circumferential void access 42 having an inlet 44 in fluid communication with a housing interior 46 and an outlet 48 in fluid communication with the through bore 34. Similarly the housing internal wall 40 defines a second circumferential void access 50 with an inlet 52 and an outlet 54, the second circumferential void access 50 providing fluid communication between the housing interior 46 and the through bore 34.

The tool 10 further comprises a first shear ram 58 and a second shear ram 60, the purpose of which will be discussed in due course, and an ignition mechanism 56 for igniting the first and second propellant sources, 36, 38.

The tool 10 is activated in a well control emergency in which it is necessary to seal the wellbore 22 by closing the shear rams 58, 60. This requires severance of the conduit 12.

The propellant sources 36, 38 are potassium perchlorate. Upon ignition by the ignition mechanism 56, the propellant sources 36, 38 deflagrate, forming a hot gas of combustion products which, due to the confines of the housing 12, is highly pressurised. The propellant sources 36,38 further comprise a modifying material in the form of a metal, in this case silver (not visible) embedded in the potassium perchlorate. The deflagration process heats the silver until the silver becomes molten.

The highly pressurised combustion products produced by the deflagration of the potassium perchlorate flows away from the propellant sources 36, 38 at great velocity as a stream of combustion products carrying with it the molten silver modifying material.

Figure 3:
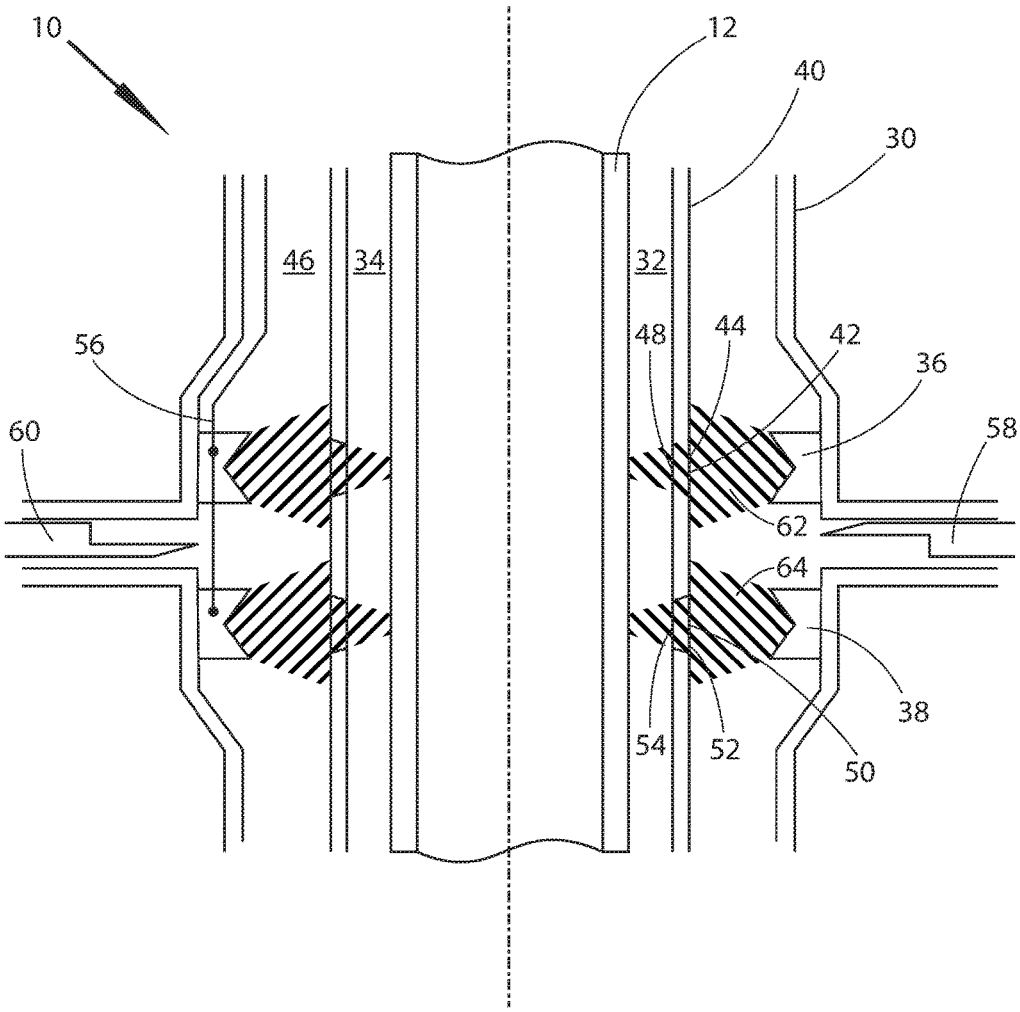
FIGS. 3 to 5 are sections of the tool of FIG. 1 in operation.

The streams of combustion gases carrying the molten silver modifying material can be seen with reference to FIG. 3, a section of the tool 10 showing the beginning of the process of severing a conduit 12.

The propellant sources 36, 38 have been ignited by the ignition mechanism 56 and the propellant sources 36, 38 have released a first stream and a second stream of combustion products 62, 64 containing the molten silver modifying material.

The streams of combustion products 62, 64 flow towards, and impinge on, the housing internal wall 40. Part of the streams of combustion products, 62, 64 flow through the first and second circumferential void accesses 42, 50 and impact on the conduit 12.

The gas within the streams of combustion products 62, 64 heat the conduit 12 and the modifying material melts the conduit 12. As the conduit melts, the streams of combustion products 62,64 move the molten material away revealing and further melting conduit material. Through this process, conduit 12 is severed or at the very least softened by the streams of combustion products 62, 64 containing the modifying material in the form of molten silver.

Figure 4:
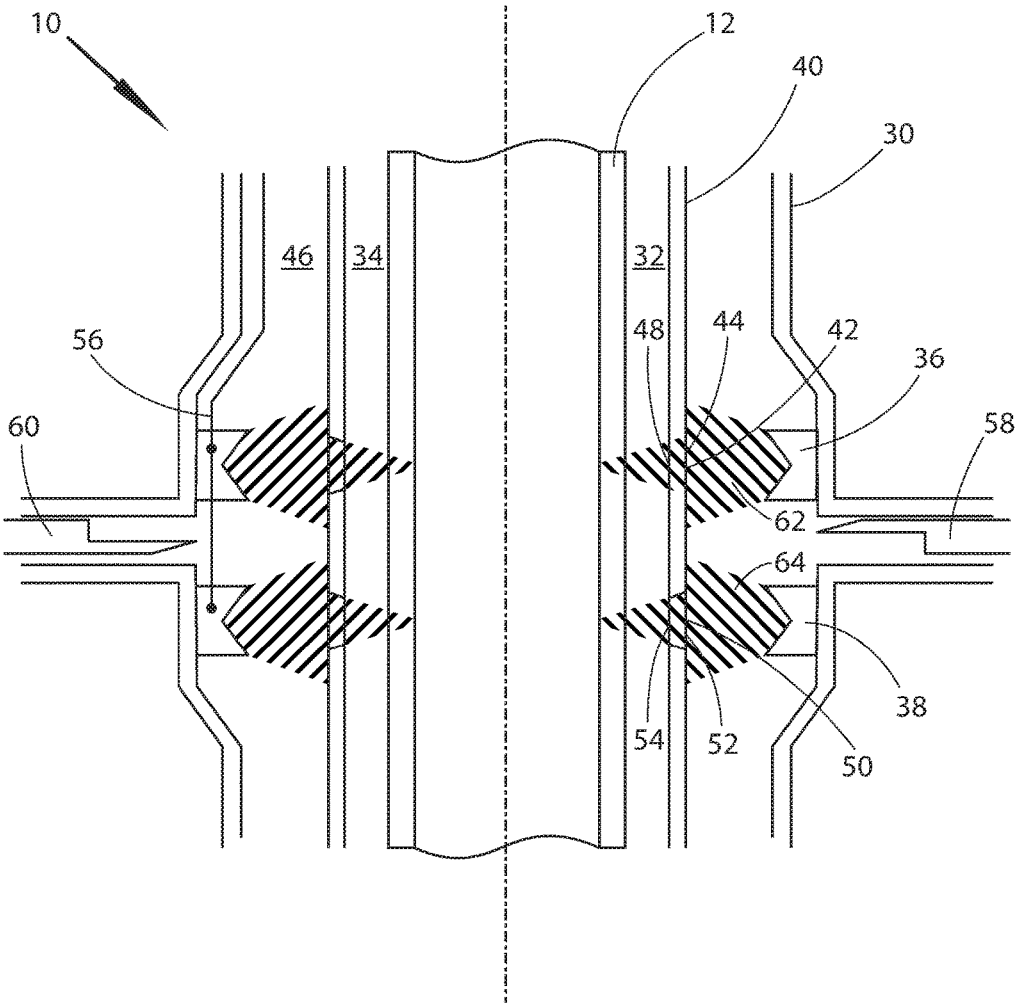
Figure 5:
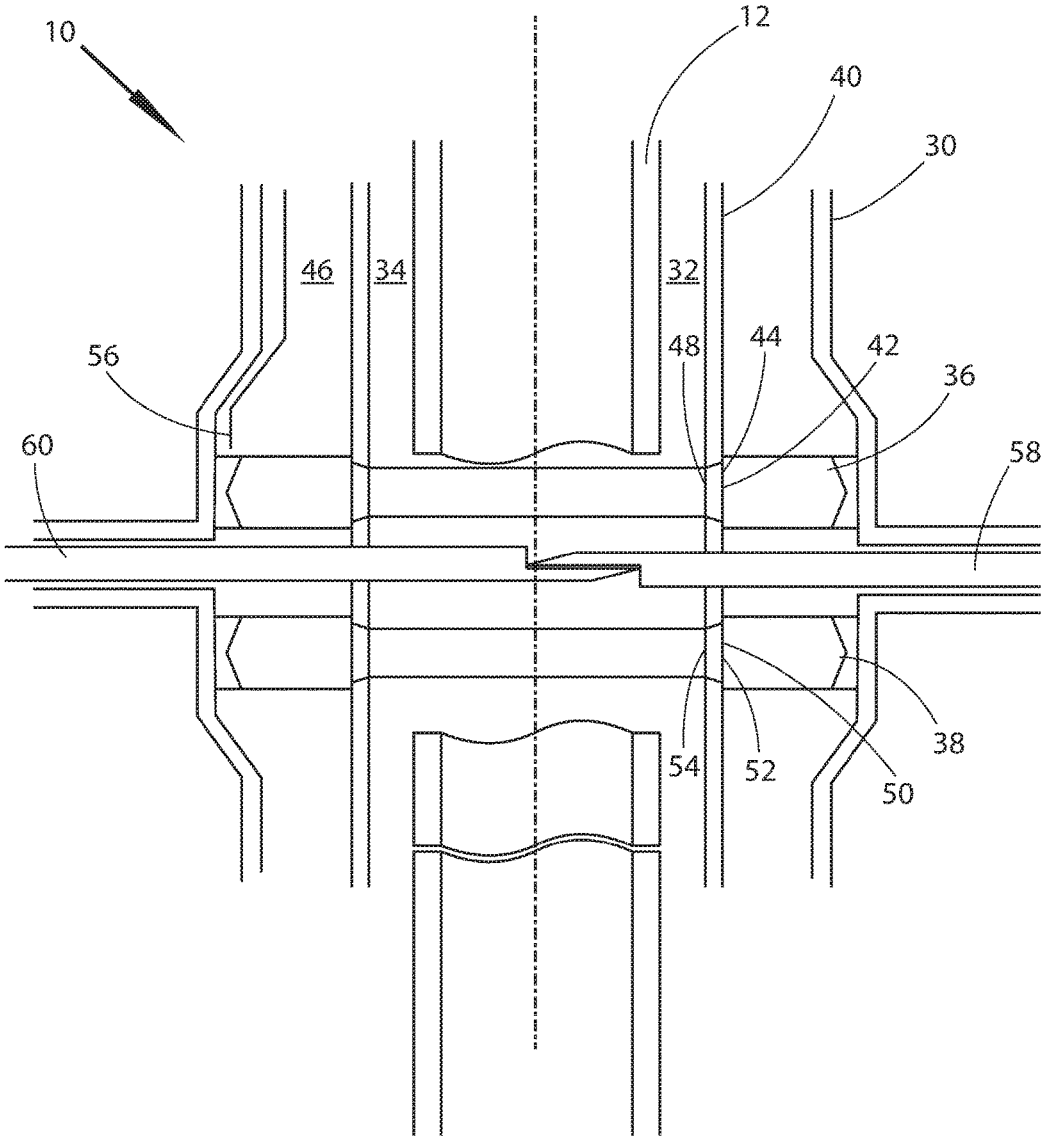

As shown in FIG. 4, the streams of combustion products 62, 64 containing the molten silver modifying material, work through the conduit 12 until, as shown in FIG. 5 the first and second propellant sources 36, 38 have been fully deflagrated, the conduit 12 has been severed and the shear rams 58, 60 can close sealing the through bore 34.

Figure 6:
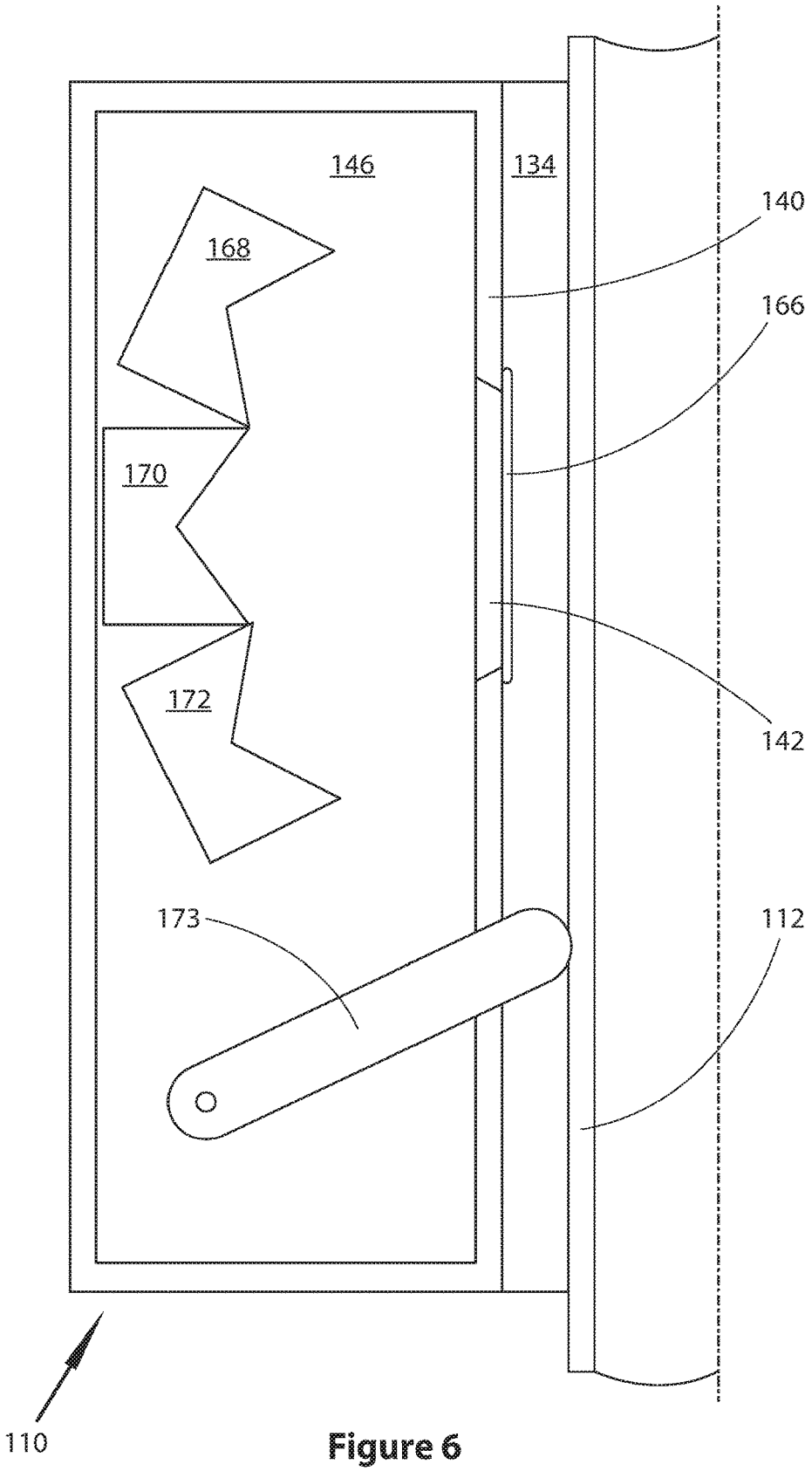
FIG. 6 is a section of a tool for severing or assisting in the severing of a conduit according to a second embodiment of the present invention

Reference is now made to FIG. 6, a section of one side of a tool 110 according to a second embodiment of the present invention.

The tool 110 is similar in many ways to the tool 10 of the first embodiment and rather than repeat the structural similarities, the primary differences will be highlighted.

The tool 110 has a single circumferential void access 142 defined by the housing internal wall 140. The circumferential void access 142 has a seal sleeve 166 covering the circumferential void access 142 to prevent ingress of well fluids from the through bore 134 into the housing interior 146.

There are three propellant sources 168, 170, 172 shown in FIG. 6. The upper and lower sources 168, 172 produce a gas, the purpose of which will be discussed in due course. The middle propellant source 170 is of similar construction to the propellants 36, 38 of the first embodiment, and produces a similar effect.

The tool 110 further comprises a positioning mechanism 173 in the form of a plurality of arms, of which one is visible in FIG. 6. These arms are pressed against the conduit 112 to bring the conduit into the optimum position for severance.

The operation of the tool 110 will now be described. To give the propellant 170 the best environment in which to sever the conduit 112, it is it is desirable to remove any well fluids in the through bore 134.

Figure 7:
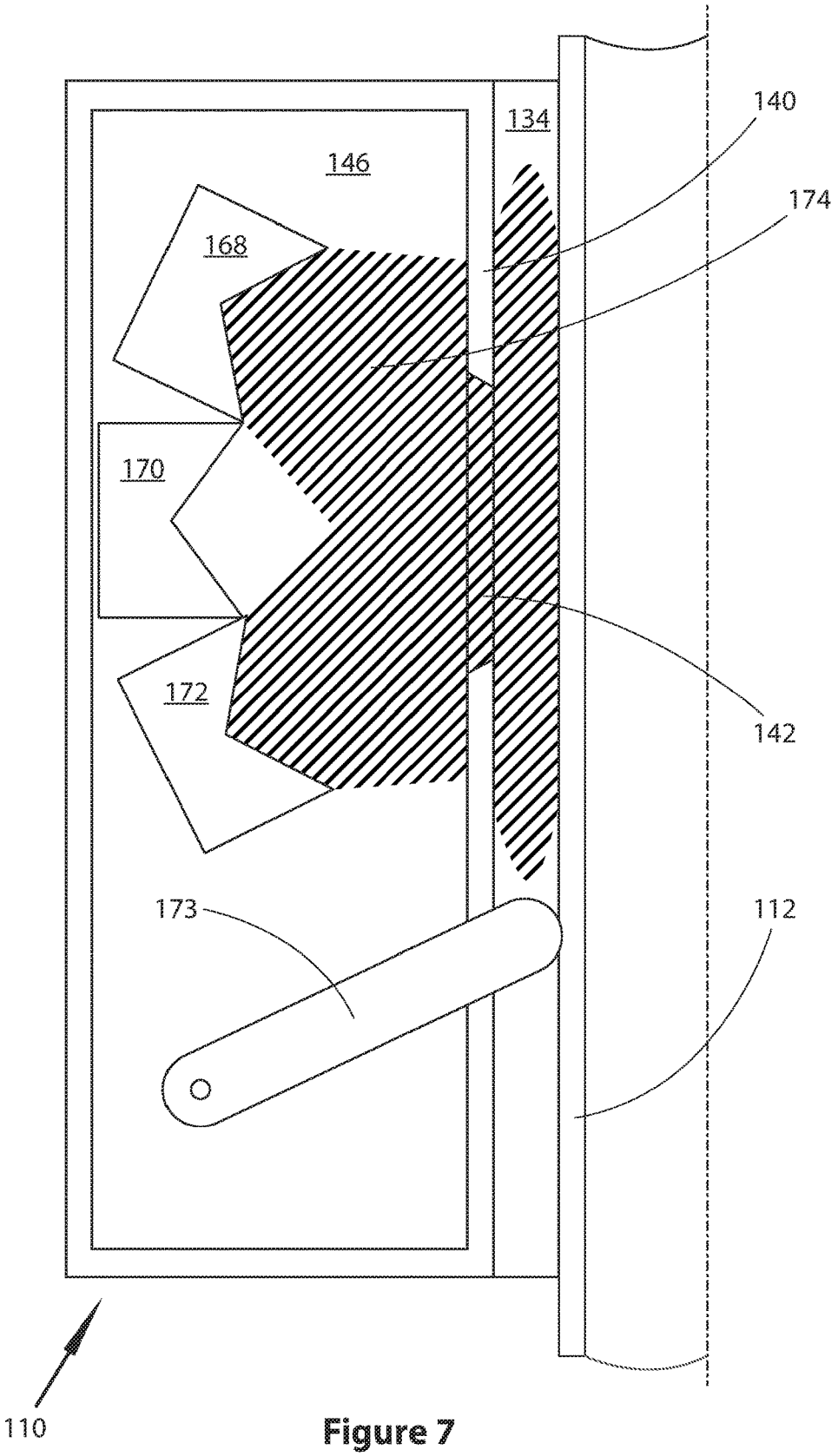
FIGS. 7 and 8 are sections of part of the tool of FIG. 6 in operation.

Referring to FIG. 7, the conduit has been positioned in the optimum position with respect to the tool 110 by the positioning mechanism 173. Once positioned, the upper and lower gas producing propellant sources 168, 172 are ignited by the ignition mechanism (not visible) creating a flow of high pressure combustion gas 174. This pressurises the seal sleeve 166 (not shown in FIG. 7) until the seal sleeve 166 ruptures and the gas 174 escapes through the void access 142 into the through bore 134, driving well fluids away from the propellant source stream of combustion products and modifying material (shown in FIG. 8).

Figure 8:
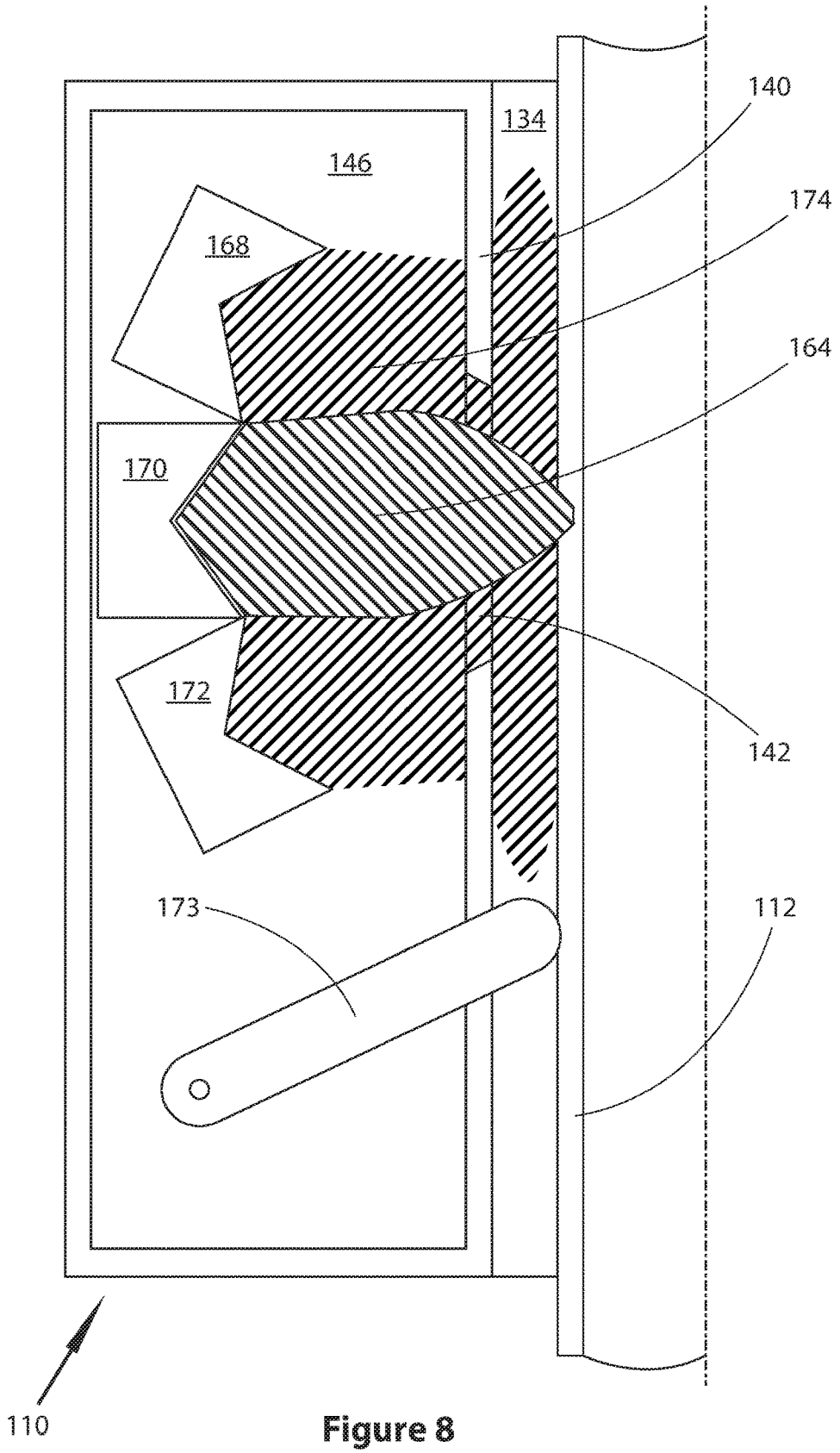

Referring to FIG. 8, a potassium perchlorate propellant 170 is then ignited by an ignition mechanism (not visible) and a stream of combustion products carrying a modifying material 164, in this case garnet, flows towards the conduit 112. The high pressure combustion gas 174 formed from the deflagration of the upper and lower gas producing propellant sources 168, 172 channels the stream of combustion products 164 towards the target. On impact with the conduit 112, the garnet modifying material is in solid form and removes material from the conduit 112 by abrasion.

The use of the combustion gas 174 reduces friction between the stream of combustion products carrying a modifying material 164 and the housing wall 140 around the void access 142. This maximises the energy of the stream of combustion products 164, thereby increasing the efficiency of the severing of the conduit 112.

Figure 9:
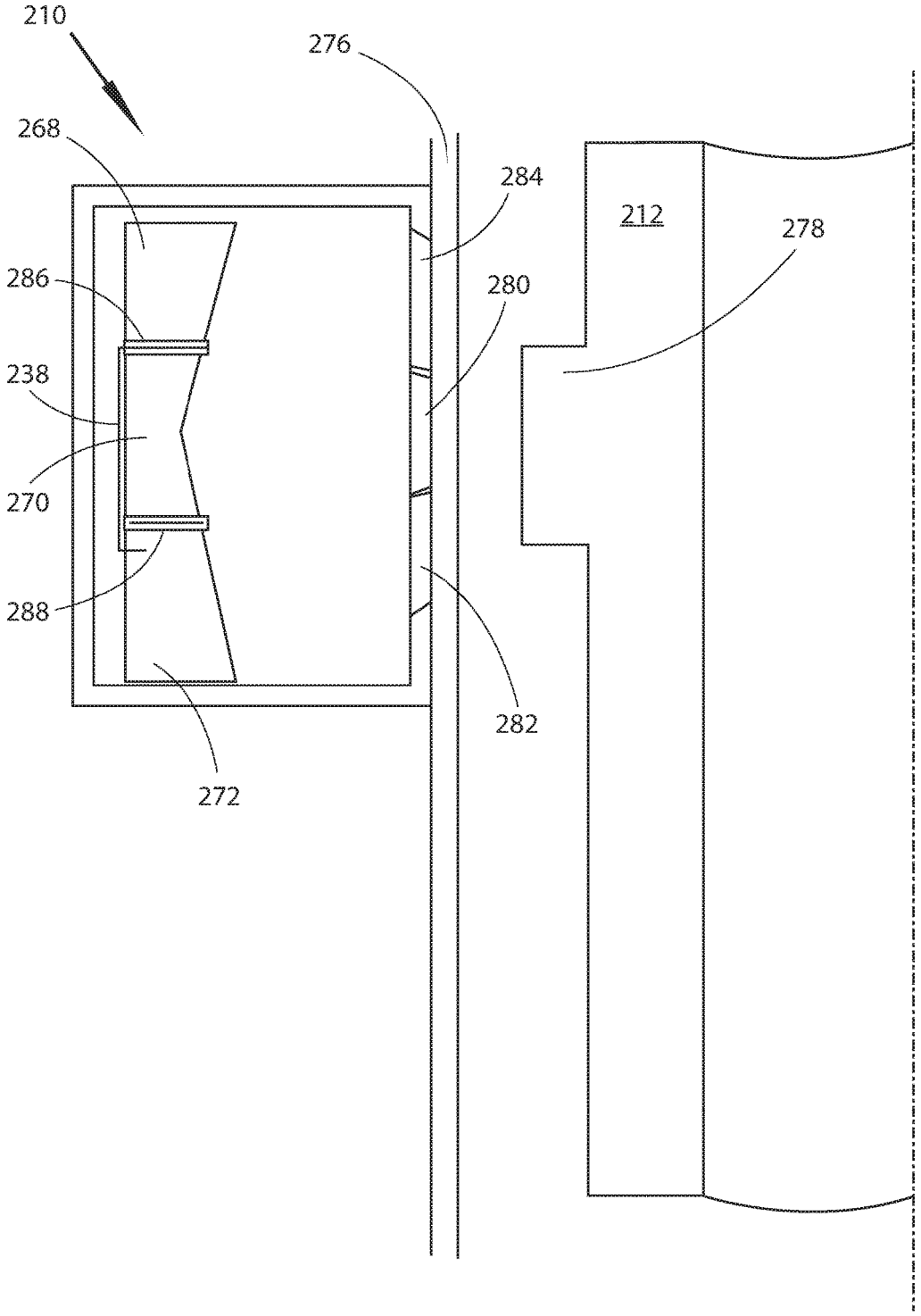
FIG. 9 is a section of a tool for severing or assisting in the severing of a conduit according to a third embodiment of the present invention.

FIG. 9 shows a third embodiment of a tool 210 for severing through a conduit 212. In this case the tool 210 is fitted to the outside of a tubular 276 through which the conduit 212 passes. The conduit 212 has an increased diameter portion 278 which, in essence, is a non-shearable object in that the increased diameter portion 278 is too thick for a conventional BOP to sever using conventional shear rams.

The tool 210 utilises three potassium perchlorate propellant sources 268, 270, 272, each propellant source being associated with a void access 280, 282, 284, each void access 280, 282, 284 being arranged to channel a stream of combustion products and a molten silver modifying material (not shown in this Figure but discussed in due course) towards a different focal point, progressively an increasing distance away from the tool 210.

The tool 210 further comprises an ignition mechanism 238 and a first and second barrier 286, 288. The barriers 286, 288 prevent one propellant source 268, 270, 272 igniting an adjacent propellant source 268, 270, 272 as will be shown.

The operation of the tool 210 will now be described with reference to FIG. 10.

Figure 10:
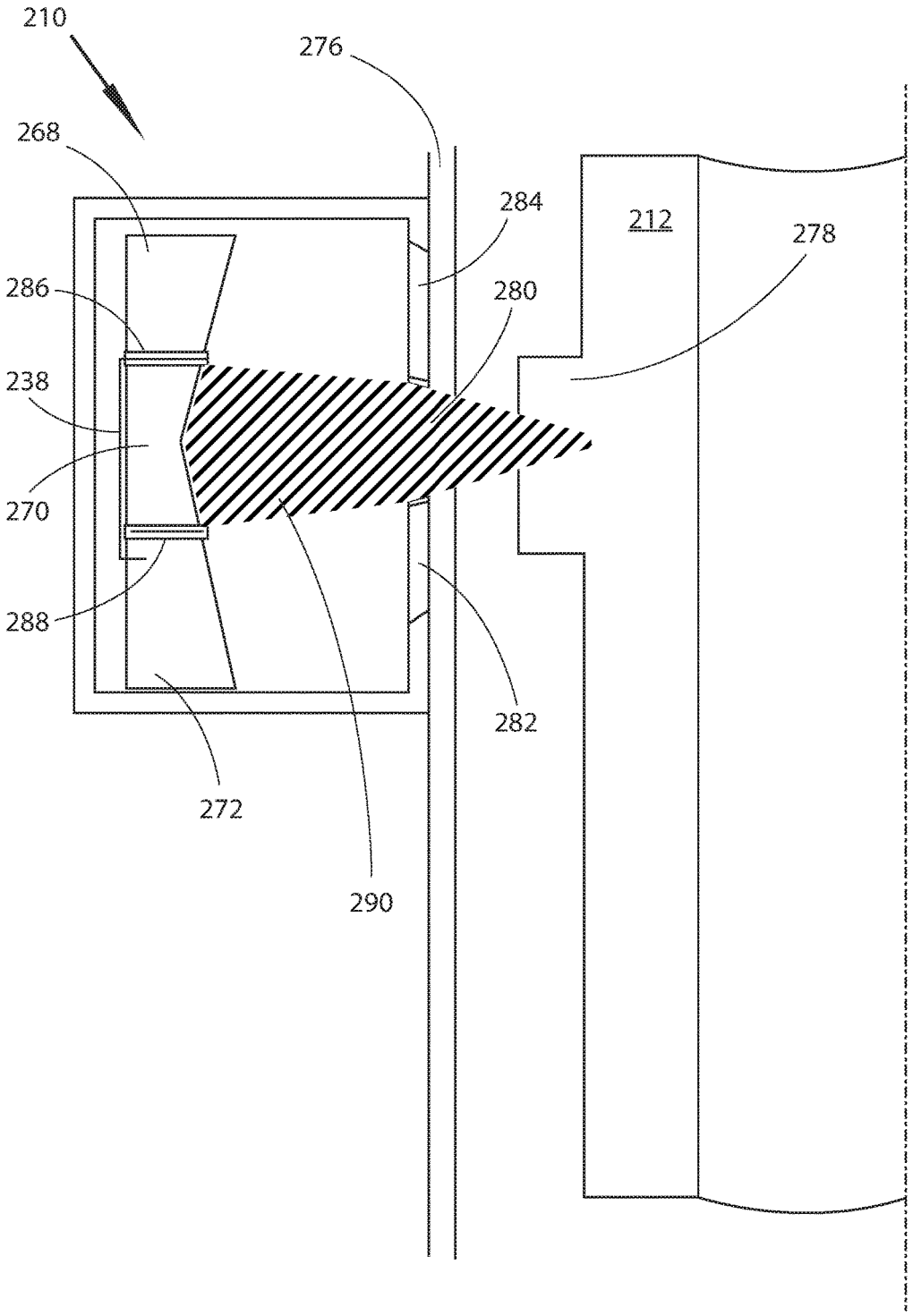
FIGS. 10 to 13 are sections of part of the tool of FIG. 9 in operation.

As shown in FIG. 10, the first propellant source 270 has been ignited by the ignition mechanism 238 and a first stream of combustion products and modifying material 290 flows through the first void access 280, first piercing the tubular 276 and then moving material from the conduit increased diameter portion 278.

Figure 11:
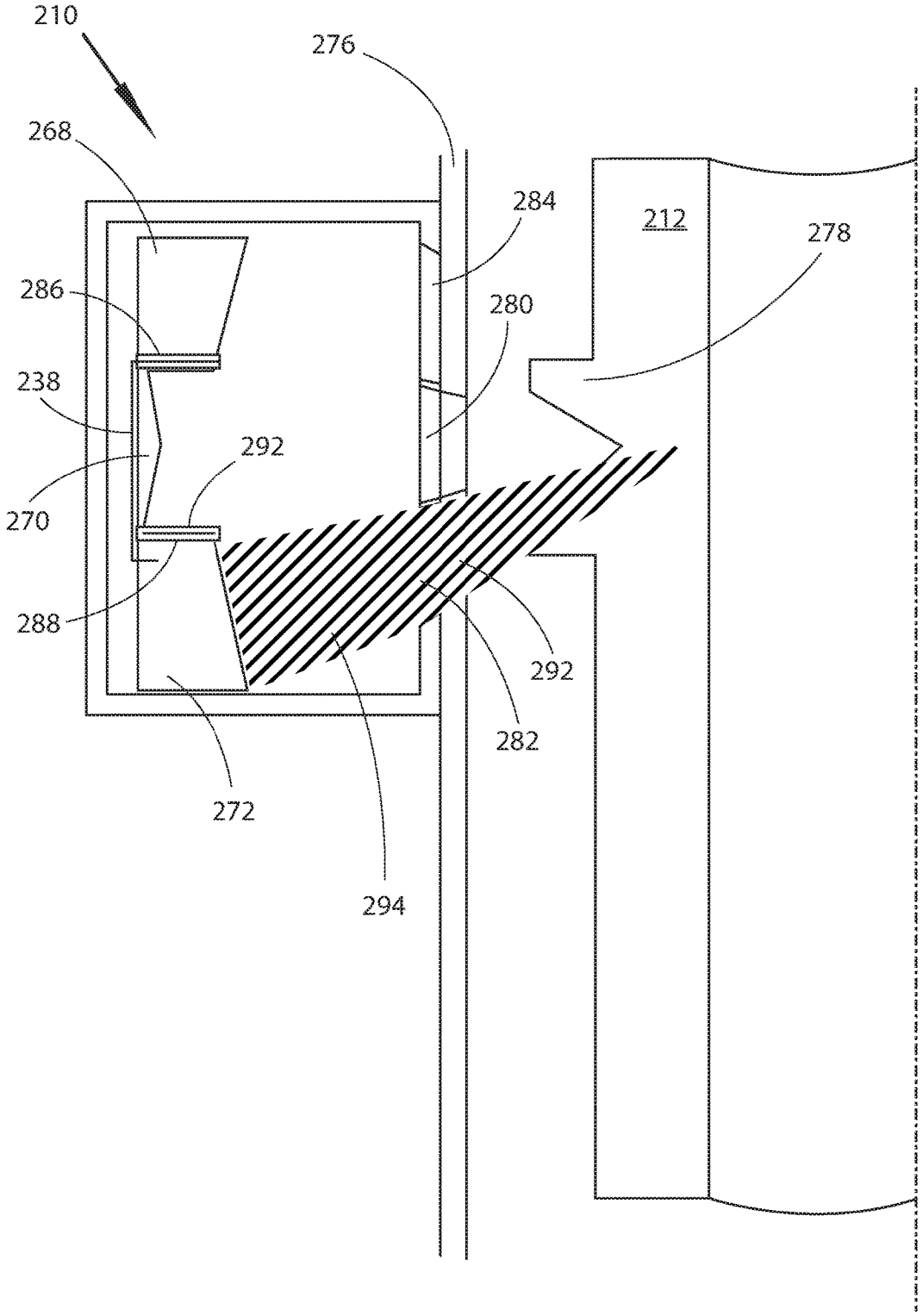

Referring to FIG. 11, the first propellant source 270 has completed deflagration and the flame transfers up a first fuse 292 inside the second barrier 288 to the second propellant source 272 which deflagrates producing a second stream of combustion products and modifying material 294 which flows through the second void access 282, first piercing the tubular 276 and then moving material from the conduit increased diameter portion 278. It will be noted that the focal point of this second stream of combustion products and modifying material 294 is deeper into the conduit increased diameter portion 278.

Figure 12:
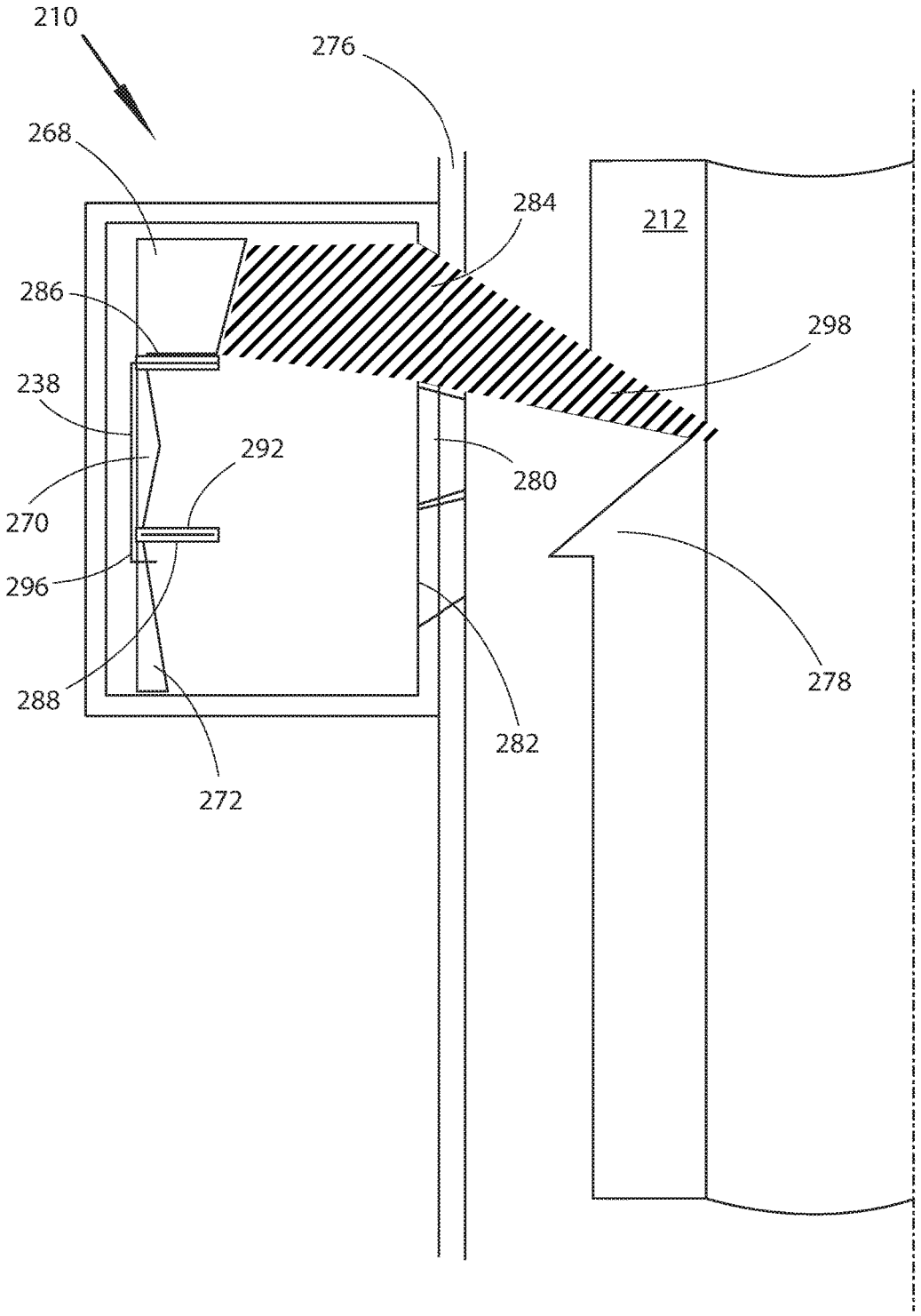

Referring to FIG. 12, the second propellant source 272 has completed deflagration and the flame transfers up a second fuse 296 inside the ignition mechanism 238 to the third propellant source 268 which deflagrates producing a third stream of combustion products and modifying material 298 which flows through the third void access 284, first piercing the tubular 276 and then moving material from the conduit increased diameter portion 278. It will be noted that the focal point of this third stream of combustion products and modifying material 298 is deeper again into the conduit increased diameter portion 278.

Figure 13:
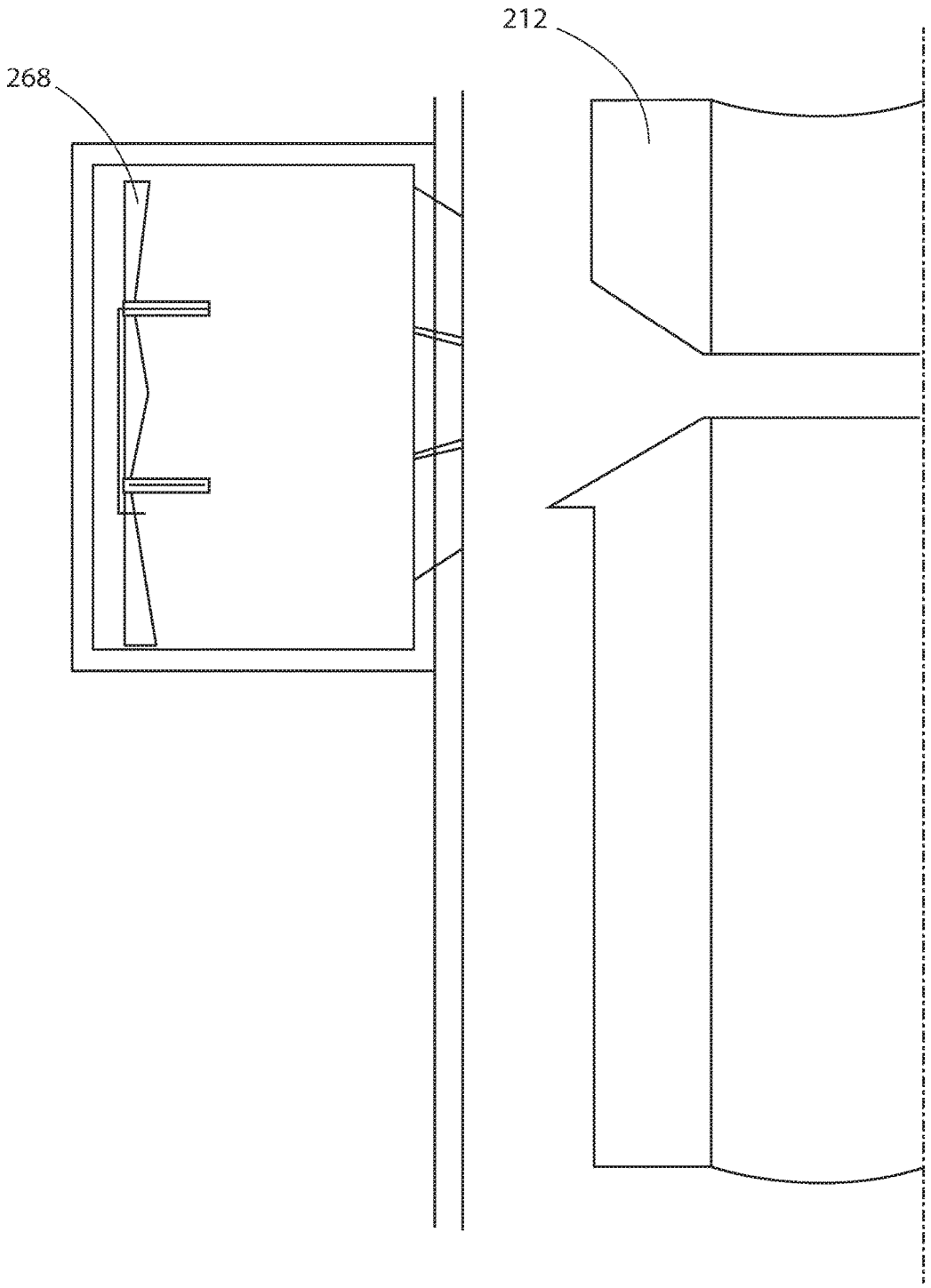

Finally referring to FIG. 13, upon completion of the deflagration of the third propellant source 268, the conduit 212 is severed.

Figure 14:
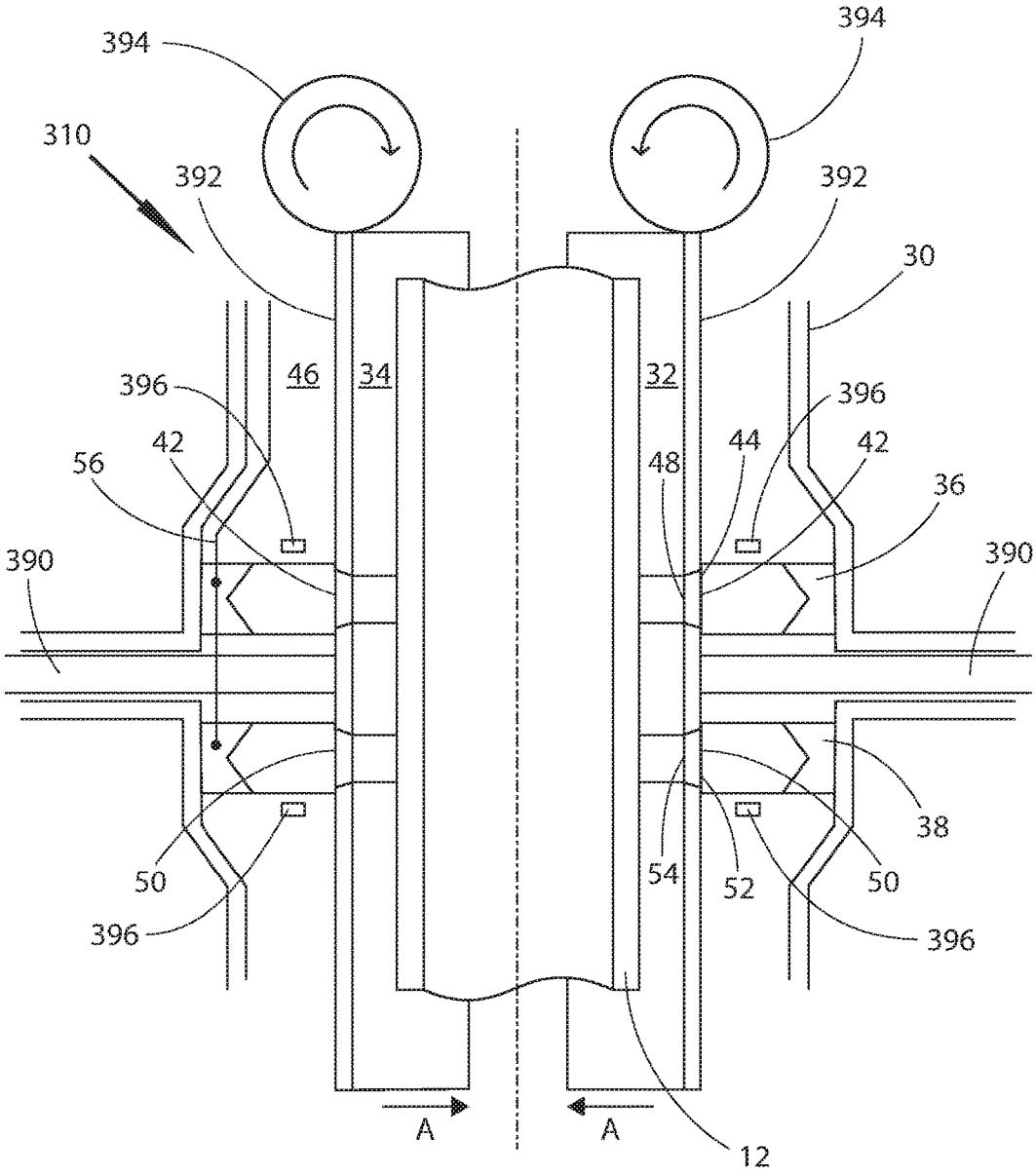
FIG. 14 shows a section of a tool according to another embodiment of the invention.
Figure 14A:
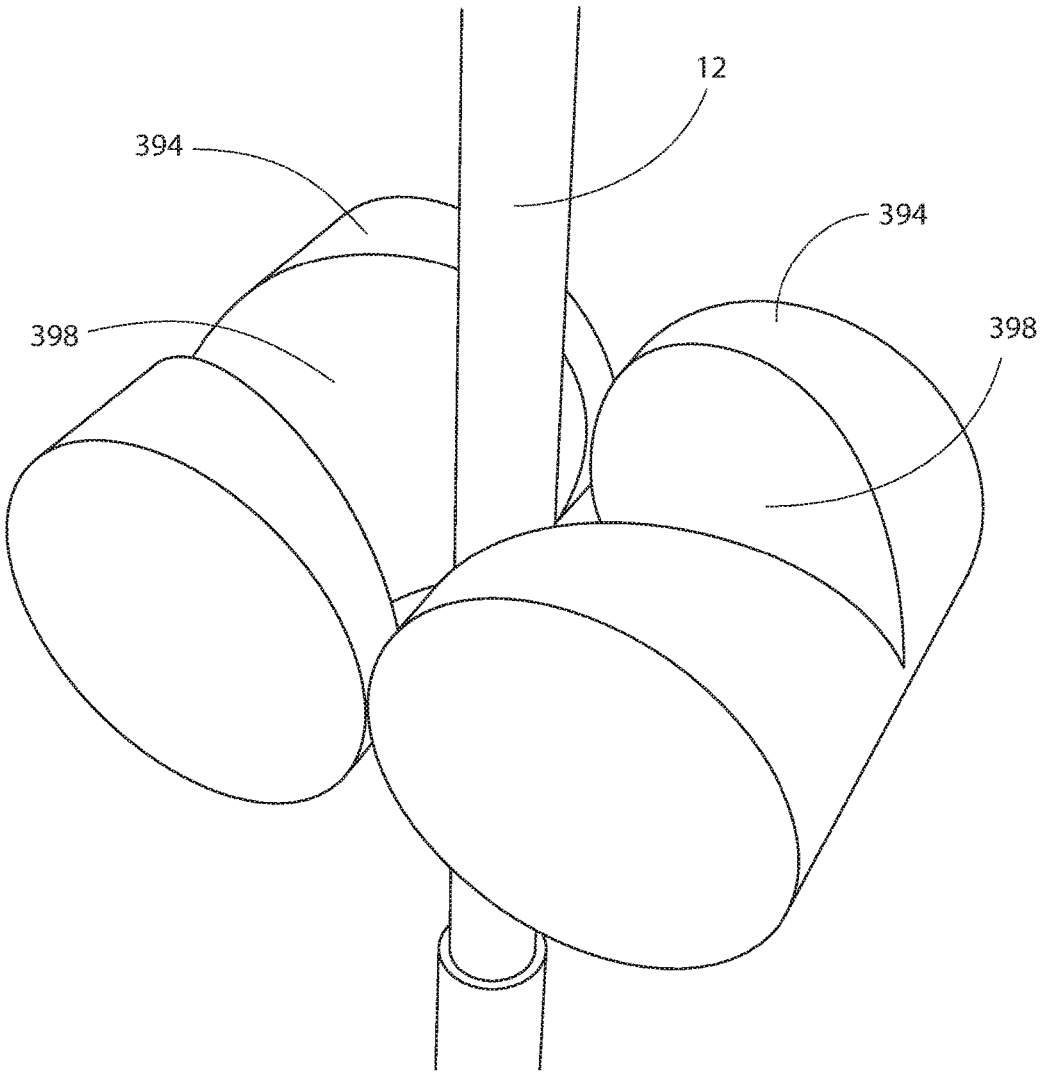
FIG. 14A shows a detail of the tool of FIG. 14.

FIG. 14 shows a section of a tool 310 in a view similar to that of the tool shown in FIG. 2. Like parts are numbered the same as in FIG. 2. In this embodiment pistons 390 can be used to drive moveable carriers 392 towards each other (direction shown by arrows A); or away from each other. The carriers 392 mount void accesses 42 and 50. Carriers 392 also mount rollers 394 that are configured to rotate into engagement with the conduit 12. As shown in perspective detail view FIG. 14A the rollers 394 include recesses 398 for receiving a conduit 12.

Also shown in FIG. 14 are energy providers 396 for imparting additional energy into the streams of combustion products and/or the modifying material employed. Thus, energy providers 396 may be electric arc generators, induction coils, or other mechanisms for generating a magnetic field and/or electric field. Alternatively, energy providers 396 may be microwave generators, providing microwave radiation to the combustion products and/or modifying material.

Figure 15:
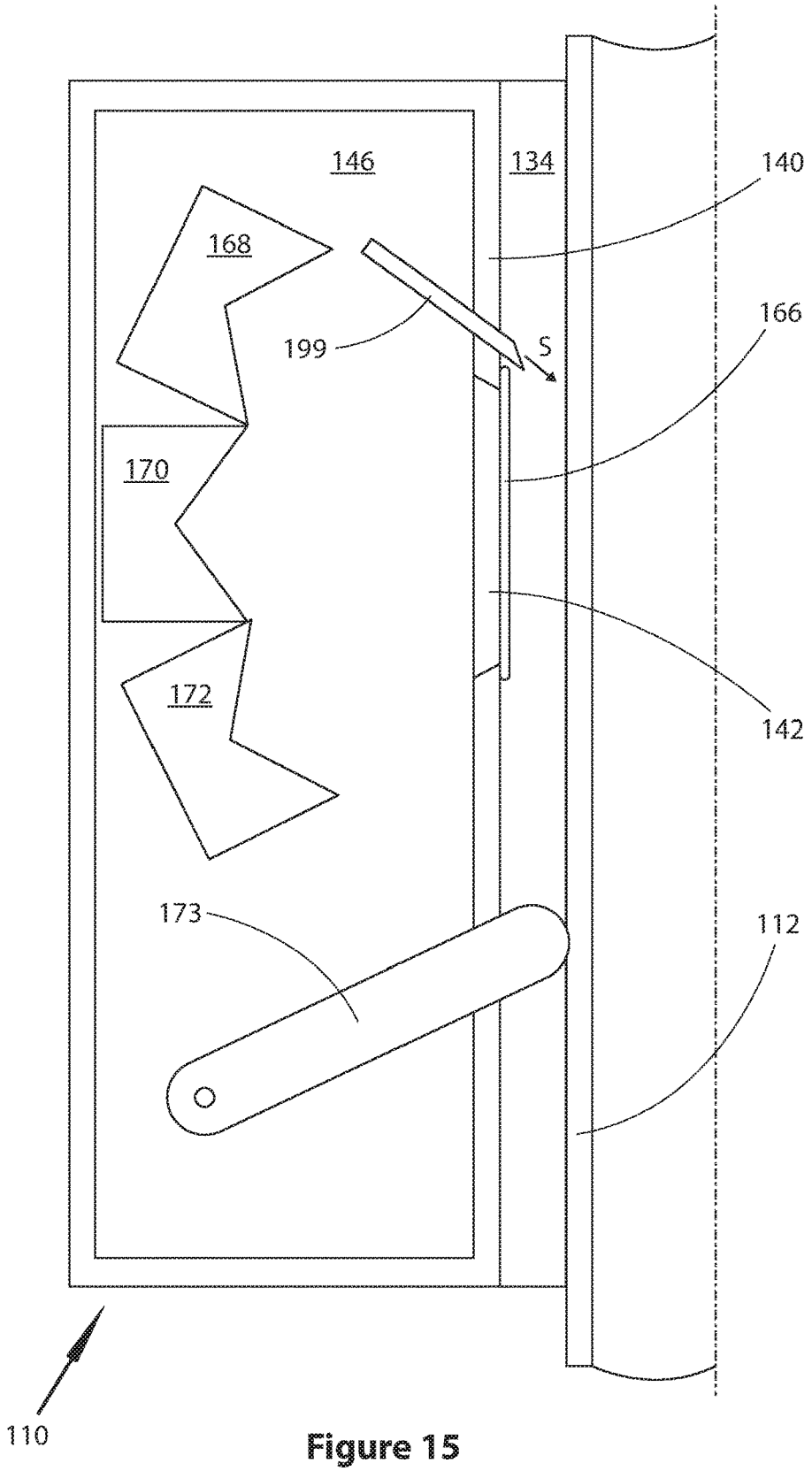
FIG. 15 shows a section of a tool similar to that of FIG. 6 but including a scraper.

FIG. 15 shows the tool 110 of FIG. 6 but fitted with a scraper 199. Scraper 199 is moveable in the direction of arrow S to scrape away molten or softened material from conduit 112 in use of tool 110.

Various modifications and improvements may be made to the above described embodiments without departing from the scope of the invention. For example, although the tool is described integrated into a blow out preventer (BOP), to form an integral part of the BOP, the tool may be positioned adjacent a BOP. In other embodiments it can be used with other suitable well control equipment, for example a rigless/riserless well intervention system or in other locations such as with a riser or as part of a downhole completion.

When used with a riser, the tool may form an integral part of the riser. In some embodiments the tool may sever the riser itself in an emergency, including all the control lines and other equipment items. For this functionality it may also include a sealing mechanism to seal off the riser itself and prevent a spill of the fluids in the riser to sea.

Similarly, when integrated into a downhole completion to form an integral part of the downhole completion the tool may also include a sealing mechanism to seal off the well itself to prevent fluids travelling up the wellbore to surface.

In all of these locations the tool may act as the primary method for severing shearable and/or non-shearable items that may be passing through the tool void.

The invention claimed is:

1. A tool for severing or assisting in the severing of a conduit, the tool comprising:

a housing defining a void, the void arranged, in use, to at least partially encircle a conduit;

an at least one propellant source located within the housing;

an at least one void access providing fluid communication from the interior of the housing to the void, the at least one void access having an inlet and an outlet, the at least one void access inlet being in fluid communication with the housing and the at least one void access outlet being in fluid communication with the housing void;

an ignition mechanism for igniting the at least one propellant source; and an at least one modifying material;

wherein, upon ignition, the at least one propellant source deflagrates, creating an at least one stream of combustion products including propellant gas, the at least one stream of combustion products flowing out of the tool through the at least one void access in to the void, the at least one void access channelling the at least one stream of combustion products towards the conduit, the at least one stream of combustion products combining with the at least one modifying material to sever or assist in severing the conduit.

2. A tool according to claim 1, wherein the housing void is a housing throughbore, the housing throughbore, in use, encircling a conduit.

3. A tool according to claim 1, wherein the at least one stream of combustion products heats the conduit to a temperature sufficient to soften the conduit, and the modifying material impinges on at least a portion of the conduit, transferring energy to the conduit to be manipulated, thereby forcibly displacing or moving the conduit portion.

4. A tool according to claim 1, wherein there are a plurality of void accesses.

5. A tool according to claim 4, wherein the plurality of void accesses is arranged in an array.

6. A tool according to claim 5, wherein each of the plurality of void accesses in the array of void accesses has a focal point the same distance from the void longitudinal axis as every other void access in the array.

7. A tool according to claim 1, wherein a stream of combustion products and modifying material flows through each void access or array of void accesses in a sequence.

8. A tool according to claim 1, wherein the at least one void access is defined by a housing wall.

9. A tool according to claim 8, wherein the at least one void access is an aperture in the housing wall, the aperture having a sidewall.

10. A tool according to claim 9, wherein the aperture sidewall channels the stream of combustion products and/or the/each modifying material.

11. A tool according to claim 1, wherein the tool includes an at least one carrier, the/each void access being mounted to the/each carrier.

12. A tool according to claim 11, wherein the/each carrier is movable between a retracted position and a deployed position.

13. A tool according to claim 12, wherein in the deployed position the/each carrier is adjacent to the conduit.

14. A tool according to claim 11, wherein the carrier comprises rams movable in a plane perpendicular to a tool longitudinal axis.

15. A tool according to claim 11, wherein the carrier comprises rollers configured to rotate into engagement with the conduit.

16. A tool according to claim 15, wherein the rollers defines a recess for receiving the conduit.

17. A tool according to claim 1, wherein the at least one modifying material includes solid particles.

18. A tool according to claim 1, wherein the at least one modifying material contains liquid droplets.

19. A tool according to claim 1, wherein at least one modifying material is included within the propellant source.

20. A tool according to claim 1, wherein at least one modifying material is a metal.

21. A tool according to claim 20, wherein the metal at least partially melts as the/each propellant source deflagrates.

22. A tool according to claim 20 wherein the metal at least partially oxidises.

23. A tool according to claim 1, wherein at least one modifying material is formed by the at least partial deflagration of the propellant source.

24. A tool according to claim 1, wherein at least one modifying material is formed separately from the deflagration of the propellant source.

25. A tool according to claim 1, wherein at least one modifying material is present in the tool prior to ignition of the propellant source.

26. A tool according to claim 1, wherein at least one modifying material is introduced into the stream of combustion products.

27. A tool according to claim 1, wherein at least one modifying material is mechanically or forcibly introduced into the propellant gas and/or the stream of combustion products.

28. A tool according to claim 1, wherein the tool includes a positioning mechanism for positioning a conduit, in use, with respect to the/each void access.

29. A tool according to claim 28, wherein the positioning mechanism centres the conduit with respect to the void.

30. A tool according to claim 28, wherein the positioning mechanism comprises a plurality of positioning devices, each device being configured to engage the conduit.

31. A tool according to claim 28, wherein the positioning mechanism centres the conduit with respect to a longitudinal axis of the void defined by the housing.

32. A tool according to claim 1, wherein the/each void access is movable with respect to the conduit to a position where the severing action of the/each stream of combustion products and modifying material is optimised.

33. A tool according to claim 1, wherein the tool is configured, within a fluid filled environment, to locally purge the medium between the void accesses and the conduit, and replace this medium with a medium of lower density.

34. A tool according to claim 33, wherein the medium of lower density is a gas.

35. A tool according to claim 34, wherein the tool produces the gas through propellant deflagration.

36. A tool according to claim 34, wherein the gas is used to displace the fluid in the vicinity of the tool.

37. A tool according to claim 1, wherein the tool further includes a sealing mechanism.

38. A tool according to claim 37, wherein the sealing mechanism is adapted to form a seal to isolate a section of the conduit.

39. A tool according to claim 37, wherein the sealing mechanism is a packer or sealing element above and/or below the housing.

40. A tool according to claim 1, wherein the tool comprises a restraining or fastening mechanism to restrict relative movement between the tool and the conduit.

41. A tool according to claim 40, wherein the restraining or fastening mechanism forms a seal on the conduit to assist in, at least partially, confining the stream of combustion products and modifying material to a stationary conduit location.

42. A tool according to claim 1, wherein the tool is configured to impart additional forces onto the conduit, from those applied by the at least one stream of combustion products and/or the at least one modifying material.

43. A tool according to claim 42, wherein the tool applies torsion, tension or bending to the conduit.

44. A tool according to claim 1, wherein the at least one stream of combustion products and/or the at least one modifying material applies torsion or tension or bending to the conduit.

45. A tool according to claim 1, wherein the tool is configured to rotate the/each stream of combustion products in a vortex.

46. A tool according to claim 1, wherein the tool comprises a shearing mechanism configured to seal a wellbore.

47. A tool according to claim 1, wherein the tool comprises a scraping mechanism to scrape away molten or softened conduit material.

48. A tool according to claim 1, wherein there is a plurality of propellant sources.

49. A tool according to claim 48, wherein where there is the plurality of propellant sources, each propellant source deflagrates separately.

50. A tool according to claim 49, wherein where there is the plurality of propellant sources, at least some of the propellant sources are ignited in a sequence.

51. A tool according to claim 1, wherein the at least one propellant source and, in some embodiments the associated ignition mechanism, is thermally insulated from well temperatures and/or potentially high temperatures from the stream of combustion products and/or modifying material.

52. A tool according to claim 1, wherein additional energy can be imparted to the at least one stream of combustion products and/or the at least one modifying material by ionisation.

53. A tool according to claim 52, wherein the at least one stream of combustion products and/or the at least one modifying material is at least partially ionised by at least part of the at least one stream of combustion products and/or the at least one modifying material coming into contact with an electrical arc.

54. A tool according to claim 52, wherein the at least one stream of combustion products and/or the at least one modifying material is ionised by passing through an induction coil.

55. A tool according to claim 52, wherein additional energy can be imparted to the at least one stream of combustion products and/or the at least one modifying material by passing at least a portion of the stream of combustion products and/or the modifying material through a magnetic field and/or electric field.

56. A tool according to claim 52, wherein additional energy can be imparted to the at least one stream of combustion products and/or the at least one modifying material by passing at least a portion of the stream of combustion products and/or the modifying material through microwave radiation.

57. A tool according to claim 52, wherein additional energy can be imparted to the at least one stream of combustion products and/or the at least one modifying material by raising its temperature.

58. A method of severing or assisting in the severing of a conduit, the method comprising the steps of:

providing a tool having a housing, the housing defining a void, the void at least partially encircling a conduit to be severed;

igniting an at least one propellant source located within the housing, the at least one propellant source upon deflagration creates an at least one stream of combustion products including propellant gas, the at least one stream of combustion products flowing out of the tool through an at least one void access providing fluid communication from the interior of the housing to the void, the at least one void access channelling the at least one stream of combustion products towards the conduit, the at least one of combustion products containing and/or combining with at least one modifying material to sever or assist in severing the conduit.

* * * * *